US008726815B2

(12) United States Patent
Giampavolo et al.

(10) Patent No.: US 8,726,815 B2
(45) **Date of Patent: *May 20, 2014**

(54) PALLET GUARD

(71) Applicants: Paul Giampavolo, Wharton, NJ (US); Robert N. Shelton, Princeton, MA (US)

(72) Inventors: Paul Giampavolo, Wharton, NJ (US); Robert N. Shelton, Princeton, MA (US)

(73) Assignee: Paul Giampavolo, Wharton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/826,447

(22) Filed: Mar. 14, 2013

(65) Prior Publication Data

US 2013/0220183 A1 Aug. 29, 2013

Related U.S. Application Data

(63) Continuation of application No. 10/676,412, filed on Sep. 30, 2003, now Pat. No. 8,424,467.

(60) Provisional application No. 60/415,484, filed on Oct. 1, 2002, provisional application No. 60/476,261, filed on Jun. 4, 2003.

(51) Int. Cl.
*B65D 19/00* (2006.01)

(52) U.S. Cl.
USPC ..... 108/51.11; 108/27; 108/193

(58) Field of Classification Search
USPC ..... 108/51.11, 27, 55.1, 56.1, 60, 180, 192, 108/193, 147.12, 147.13, 147.14, 147.15, 108/147.21, 148, 158.11; 211/126.1; 248/346.01
See application file for complete search history.

(56) References Cited

U.S. PATENT DOCUMENTS

| | | | |
|---|---|---|---|
| 3,181,176 | A | 5/1965 | Nagy et al. |
| 3,777,673 | A | 12/1973 | Blazey et al. |

(Continued)

FOREIGN PATENT DOCUMENTS

| | | |
|---|---|---|
| CA | 2094895 | 11/1993 |
| CA | 2151735 | 7/1994 |
| CA | 2 375 246 | 12/2000 |
| JP | 11 208633 | 8/1999 |

OTHER PUBLICATIONS

Examiner's Report dated Mar. 19, 2010 in corresponding Australian Patent Application No. 2003279091.
http://extranet.barneyschool.org.uk/myphysicsweb/Stability.pdf.

(Continued)

*Primary Examiner* — Jose V Chen
(74) *Attorney, Agent, or Firm* — Ostrolenk Faber LLP

(57) ABSTRACT

A guard for protecting the sides of a pallet on which goods can be stacked or a merchandise grouping placed on a support surface, the guard comprising a plurality of modular guard sections, each section being couplable to an adjacent section to surround at least a portion of the perimeter of a pallet or merchandise grouping, each modular guard section having top and bottom portions disposed between front and back portions, the bottom portion being wider than the top portion making each modular guard section substantially wedge or triangular shaped in cross section to increase the stability of the guard section, the guard sections each having a complementary portion of a joint for coupling the sections together, wherein the modular guard sections each comprise at least two telescoping members to allow adjustability of the length of a guard section; further wherein each guard section comprises complementary detent elements that allow the telescoping members to attain respective detented positions.

25 Claims, 59 Drawing Sheets

(56) References Cited

U.S. PATENT DOCUMENTS

| | | | | | |
|---|---|---|---|---|---|
| 4,079,678 | A | * | 3/1978 | Champagne | 108/110 |
| 4,609,116 | A | | 9/1986 | Simms | |
| 4,635,562 | A | | 1/1987 | Kreeger | |
| 4,715,294 | A | | 12/1987 | Depew | |
| 4,750,626 | A | * | 6/1988 | Nicely | 108/192 |
| 4,762,438 | A | | 8/1988 | Dewing | |
| 4,834,254 | A | | 5/1989 | Mead | |
| 5,123,773 | A | | 6/1992 | Yodock | |
| 5,407,084 | A | * | 4/1995 | Remmers | 108/193 |
| 5,463,966 | A | * | 11/1995 | Nilsson | 108/193 |
| 5,582,305 | A | | 12/1996 | Howell et al. | |
| 5,597,084 | A | | 1/1997 | Parasin | |
| 5,605,413 | A | | 2/1997 | Brown | |
| 5,809,902 | A | | 9/1998 | Zetterberg | |
| 5,870,958 | A | | 2/1999 | Suzuki | |
| 5,881,651 | A | | 3/1999 | Trickett | |
| 5,913,501 | A | | 6/1999 | Heuss et al. | |
| 5,944,370 | A | | 8/1999 | Ravet et al. | |
| 6,050,419 | A | | 4/2000 | Flanagan et al. | |
| 6,086,285 | A | | 7/2000 | Christensen | |
| 6,192,807 | B1 | | 2/2001 | Mason | |
| 6,234,086 | B1 | | 5/2001 | Mason | |
| 6,260,487 | B1 | | 7/2001 | Giorgio | |
| 6,408,768 | B1 | | 6/2002 | Giampavolo et al. | |
| 6,408,770 | B1 | | 6/2002 | Mason | |
| 6,651,828 | B2 | | 11/2003 | Dimattio et al. | |
| 6,920,831 | B2 | * | 7/2005 | Lin | 108/192 |
| 8,424,467 | B2 | * | 4/2013 | Giampavolo et al. | 108/51.11 |

OTHER PUBLICATIONS

Canadian Office Action dated Aug. 29, 2006 (English).

* cited by examiner

DOUBLE PALLET CONFIGURATION

PALLET GUARD

CROSS REFERENCE TO RELATED APPLICATION

The present application is a continuation of U.S. Ser. No. 10/676,412, filed Sep. 30, 2003 entitled PALLET GUARD in the names of Paul Giampavolo and Robert Shelton which claims the priority and benefit of U.S. Provisional patent applications Ser. No. 60/415,484 filed Oct. 1, 2002 entitled WEDGE SHAPED PALLET GUARD and 60/476,261 filed Jun. 4, 2003 entitled PALLET GUARD WITH INTERCHANGEABLE SIGNAGE, the entire disclosures of which are hereby incorporated by reference.

BACKGROUND OF THE INVENTION

The present invention relates generally to a protector for a pallet or a merchandise grouping placed on the floor or other support surface without a pallet, and in particular to a pallet guard that has increased stability as well as to a pallet guard with changeable displays.

DESCRIPTION OF RELATED ART

A pallet guard that is modular and adjustable is illustrated in U.S. Pat. No. 6,408,768. The disclosed pallet guard fits around a pallet on which goods for sale or display are stacked or around a merchandise grouping placed on the floor or other support surface and can be adjusted to the size of the pallet in addition to being fitted to one or more pallets placed adjacently in a group.

Palletized goods are commonly displayed for sale to customers of a business establishment. Displaying goods for sale in this manner is a convenience for business establishments or operators as a large quantity of merchandise can easily be transported out of a stock area utilizing a pallet jack or fork lift and placed with discretion around a store without further handling or arranging of the merchandise. This type of product merchandising is a convenience to store operators and sometimes creates unpleasant effects and poses dangers to its customers. The above described U.S. Pat. No. 5,408,768 shows a pallet guard which can be arranged around the bottom of the pallet to create a quick and inexpensive pleasing visual effect and also to protect customers from injury by the exposed portions of the pallet and protect merchandise from stock carts and shopping carts, which leads to trips and falls over spilled or damaged merchandise and unsaleable merchandise. The pallet guard is arranged around the pallet or merchandise and can be adjusted to the size of the pallet or area of merchandise.

It is often convenient for retailers to display goods in bulk placed on a pallet in, for example, an aisle of a store, especially a warehouse type store or outlet. Indeed, there are a number of retail establishments that operate on the basis of bulk sales in which goods are typically transported and displayed in palletized units. In this manner, the retailer can obtain cost benefits by being able to restock items as an entire pallet that can be transported from a stock area using a pallet jack or forklift and placed in a desired retail area without having to handle individual pieces. Pallets containing goods for sale are often stored in the retail area itself in storage racks accessible by forklifts that are operated continually while customers shop. Pallet guards also protect the merchandise in these racks by forming a linear barrier between the pallet edge and the selling floor, creating a pleasing visual effect, but side panels need to be used to keep it in place.

As in the case of warehouses and retail establishments that stock palletized goods, there are often dangers associated with permitting public access to bulk goods stored in palletized units. For example, pallets are often made of unfinished wood with jagged edges that can catch clothing or cause abrasions to unwary customers. Accordingly, a pallet guard can protect customers from injury, while creating a pleasant visual effect to enhance the shopping experience of customers in the retail establishment.

A problem with existing pallet guards is that they can be unstable, particularly if the pallet guard sections are connected together in a line to protect a series of pallets arranged in a line. The present invention provides a solution to this problem by providing a wedge or triangular shaped pallet guard that is stable, even when protecting a line of adjacently arranged pallets.

Another problem with existing pallet guard designs is that they contain no means of providing for an indicia of goods or services other than permanent molded-in graphics or pressure sensitive labels offered by the retailer, distributor, manufacturer or other third party related to the retail establishment, or the goods on the protected pallet. Interchangeable signage can incorporate sale items, pricing or tie into seasonal or promotional campaigns.

SUMMARY OF THE INVENTION

The present invention relates to an improved modular guard for a pallet (or a modular guard for protecting a merchandise grouping disposed on a support surface such as the floor without a pallet) having a wedge or triangular shaped design in cross section which increases the stability of the guard particularly when a plurality of the modular guards protect a series of pallets or merchandise arranged in a line.

The present invention also provides a modular guard with replaceable signage fitted to portions of the guard walls. The placement of the signage permits the guard to be expandable or collapsible without having to adjust the signage. The signage can be related to the goods around which the guard is placed, or can inform the customer about other complementary products or discounts available from manufacturers, distributors or other third parties. Advantageously, the guard has a sloped display frontage for easily viewed displays and is wedge or triangular shaped in cross section for increased stability.

Pallet guards also protect the merchandise in storage racks by forming a linear barrier along the pallet edge facing the selling floor. This barrier is created with one or more modular pallet guard sections and can be placed in a recess fashion adjacent to the rack stanchions (vertical posts of merchandise racks) in front of the pallet with the ends of the pallet guard abutting the rack stanchion. The pallet guard section can be free standing or attached to the rack stanchion. The pallet guard sections can also be coupled together behind the rack stanchions inside the bay area formed by the racking whereby the pallet guard is between the stanchions and the pallets running in a linear fashion facing the selling floor, or coupled outside of the rack stanchions forming a continuous linear barrier covering both the rack stanchions and the pallet facings. This may be free standing or attached to the stanchions.

Also pallets are sometimes placed on end isles whereby featured items are offered for sale. In this application three sides of the pallet guard are used to cover the end and side isle facings of the pallet or display thus achieving the same benefits: A pleasant finished look, protection of merchandise being displayed, protection from injuries relating to exposed pallets and damaged merchandise spills, and a fast and inexpensive method of display. Because of the wedge shape and sturdy corners, three modular panels can free stand around the end or be attached to the pallet, display base or isle end.

BRIEF DESCRIPTION OF THE DRAWINGS

FIG. 52, comprising

DETAILED DESCRIPTION OF THE PREFERRED EMBODIMENTS

Figure 1:
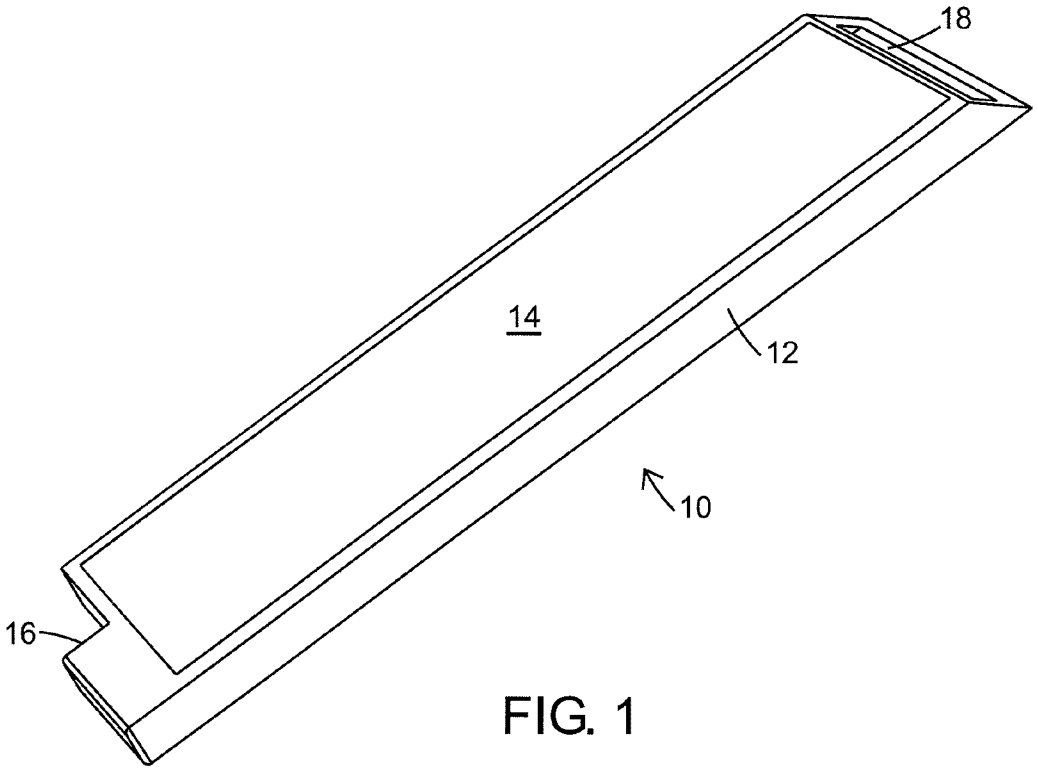
FIG. 1 is a perspective view of a pallet guard panel with signage according to an embodiment of the present invention.

Referring now to FIGS. 1-5, a section of a pallet guard with signage according to the present invention is illustrated generally as a pallet guard panel 10. Panel 10 a includes pallet guard module section 12 and a signage 14. Section 12 is part of a modular panel construction, shown in FIGS. 4 and 5 as modules 40. Modules 40 include sliding sections 42 that interlock with a complementary joint section 16 of section 12. The joint section can comprise a complementary recess in one section and projection in the other section, for example, as shown by the joint sections shown in FIG. 11, relating to a different embodiment, where a projection on section 122 interlocks with a recess in the section 120. Note that these sections can interlock either in a straight line (to protect multiple pallets in a row) or at 90° to go around a pallet corner. Sliding sections 42 are displaced in and out of opening 18 on an end of section 12 opposite to joint section 16. In accordance with this arrangement, modules 40 can be expanded or collapsed to fit a variety of sizes of pallets around which they are placed.

In accordance with the present invention, signage 14 on each section 12 is visible from an exterior of the pallet guard and pallet arrangement. Each section of module 40 can contain a different display for advertising, information or aesthetic appeal. The content of signage 14 is typically visible from all angles that modules 40 are visible. Signage 14 also can include information about the contents of goods stored on the pallet around which modules 40 are arranged. For example, it is sometimes the case that boxed goods stacked on a pallet are not easily identifiable by the exterior of the boxes. Accordingly, a customer wishing to select the desired goods from a pallet would need other indicia of the contents of the boxes to ensure proper identification and selection. Signage 14 can include descriptions of the boxed goods on the pallet, in addition to further information concerning the goods, such as, for example, price, sizes of individual containers in the boxes, special features, promotions and the like.

In accordance with the present invention, it is possible that signage 14 can be shipped with pallets of goods to be displayed and sold in a pallet format or put on at the store by retail or manufacturer's representatives. At the retail location, signage 14 is placed in sections 12 to identify the goods and any special features provided with the goods. As the goods are sold, signage 14 can be replaced with new or additional signage provided, for example, by the manufacturer or retailer to note further improvements or sales.

Figure 2:
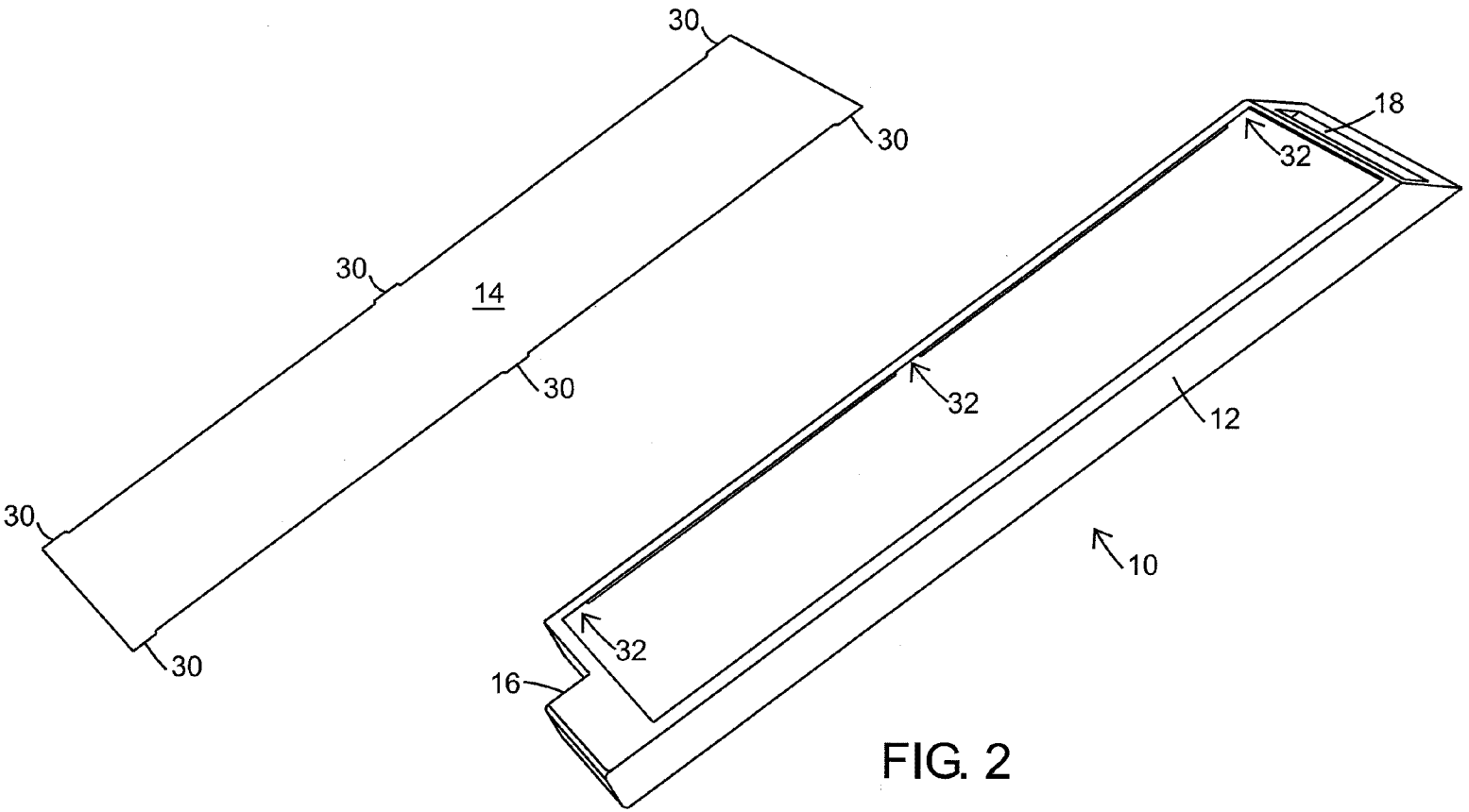
FIG. 2 is an exploded view of the view in FIG. 1.
Figure 3:
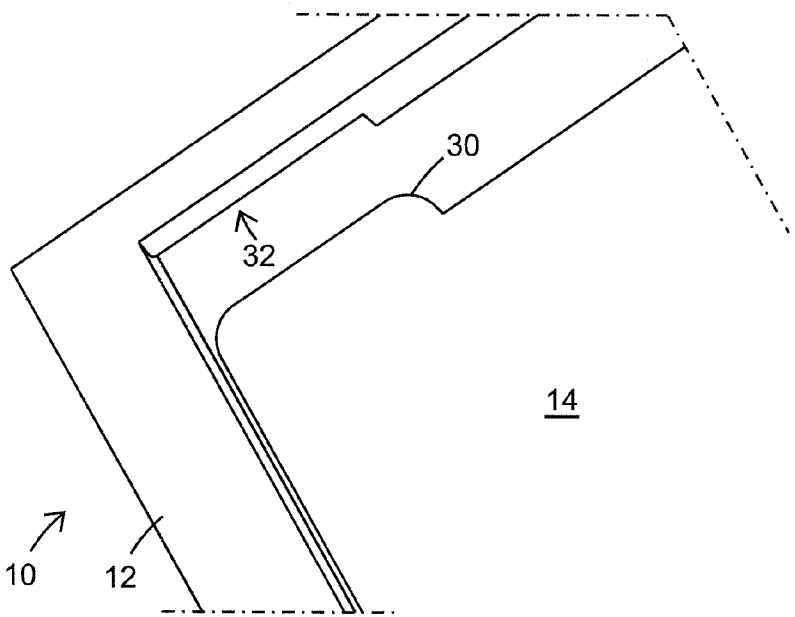
FIG. 3 is a detailed view of the embodiment of FIG. 1 showing a signage attachment mechanism.

Referring now to FIG. 3, a cutaway section of section 12 and signage 14 are shown slightly separated from each other. Signage 14 includes a tab 30 for securing signage 14 to section 12. Section 12 includes a notch 32 shaped to receive tab 30 of signage 14, and retain signage 14 in a front, flat recess of section 12. As shown in FIG. 2, a number of tabs 30 are provided on signage 14 to fit into mating notches 32 on section 12. It should be apparent that, while signage 14 is shown to have a size and shape approximately the same as that of the flat recess in section 12, the device should not be considered to be so limited. For example, signage 14 can have a greater width for the same length, so that signage 14 bows outward from section 12 in the shape of an arc or cylinder section. In addition, a number of notches 32 can be provided in section 12 to permit a number of signages 14 to be accommodated on a single section 12. It is preferred, however, that signage 14 be essentially shaped and sized to the flat recess in section 12, so that it can receive support from section 12 and obtain a level of resistance to impacts or other external forces that might otherwise damage signage 14.

Figure 4:
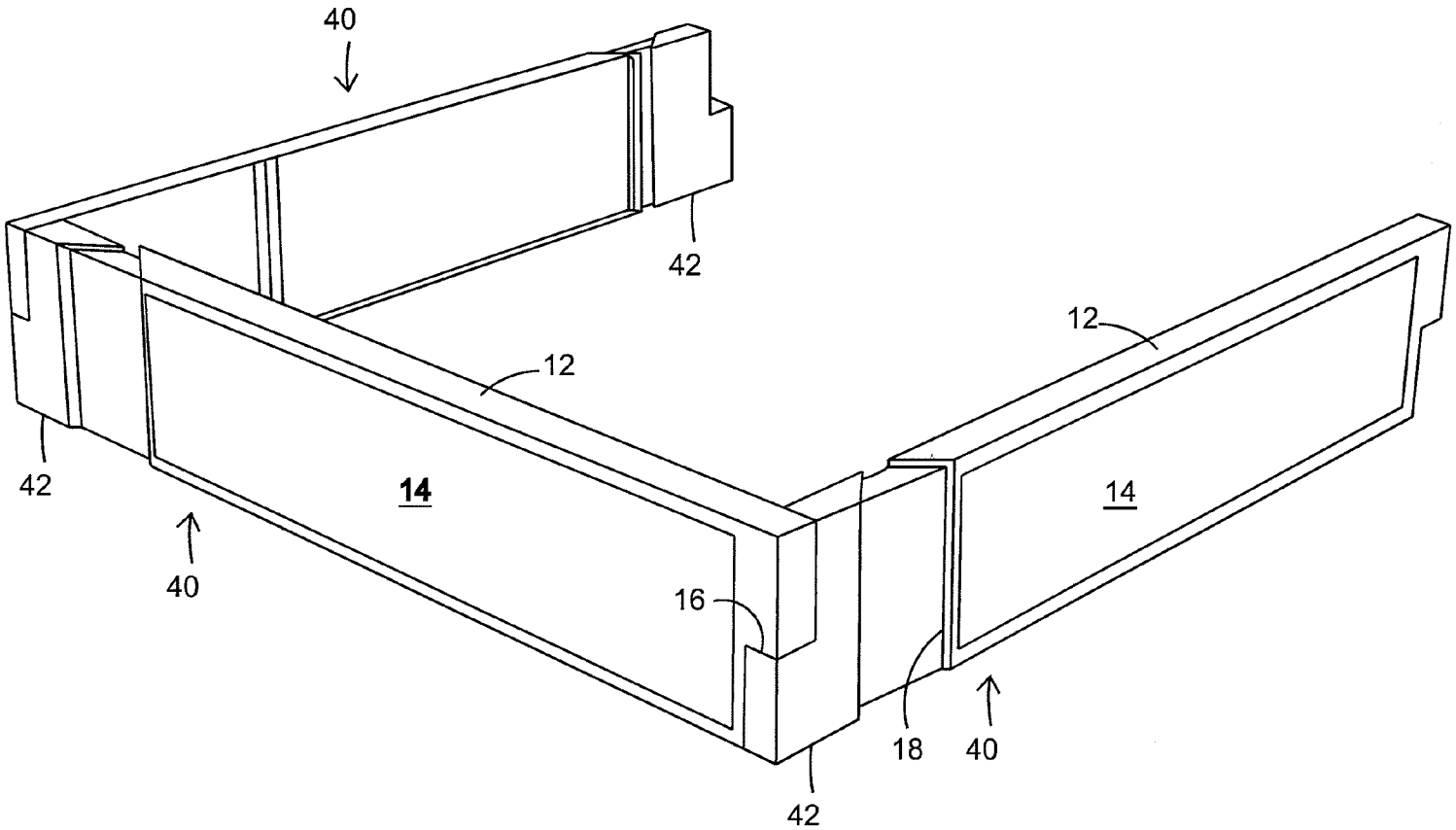
FIG. 4 is a perspective view of several assembled pallet guard panels according to the present invention.
Figure 5:
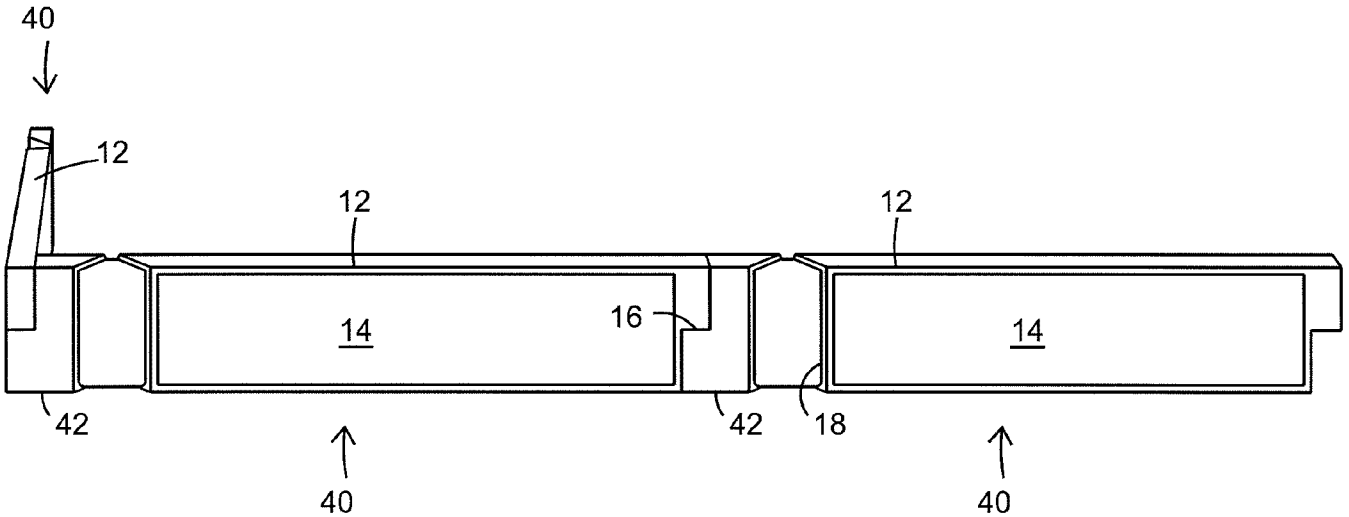
FIG. 5 is a perspective view of several pallet guard panels assembled in a modular form with a straight line connection.

Referring to FIGS. 4 and 5, it should be apparent that signages 14 can be made flexible to extend around a corner of assembled modules 40, or extend across a junction of assembled modules 40 so that signage 14 can be provided as a long ribbon-like component that attaches simply to sections 12 on the different modules 40. In such a case, signage 14 is provided with slack material to permit modules 40 to slidably expand without having to remove signage 14. It should also be apparent that signages 14 can have texture or a three-dimensional look and/or feel.

Figure 6:
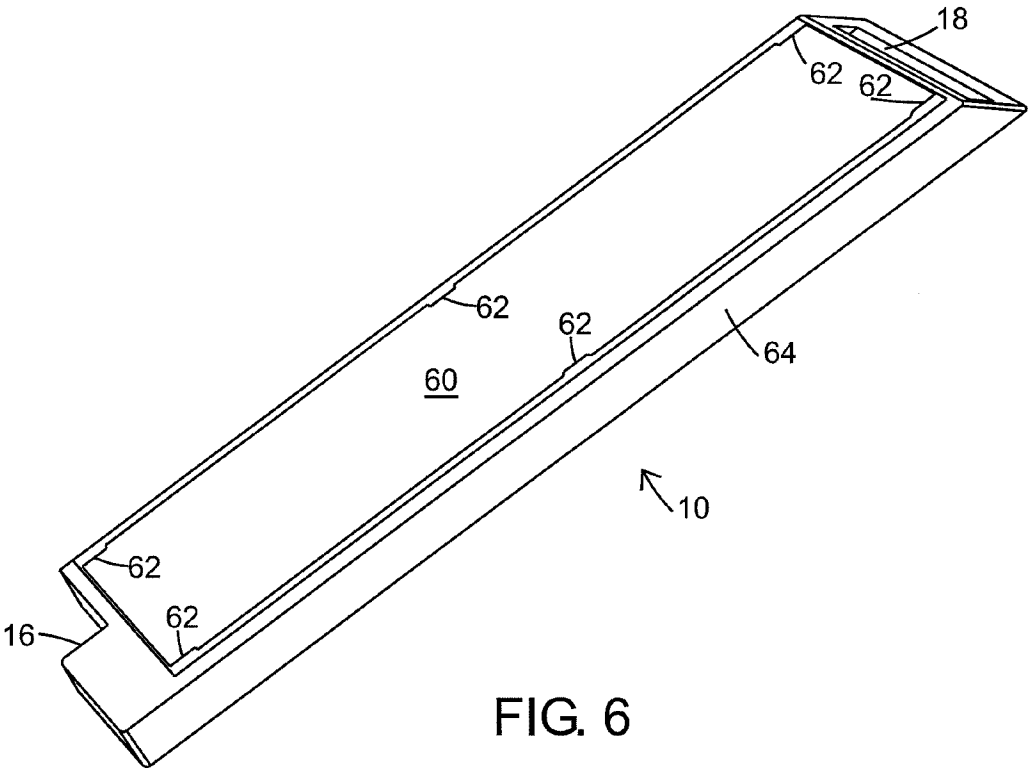
FIG. 6 is a perspective view of a pallet guard panel with signage according to another embodiment of the present invention.
Figure 7:
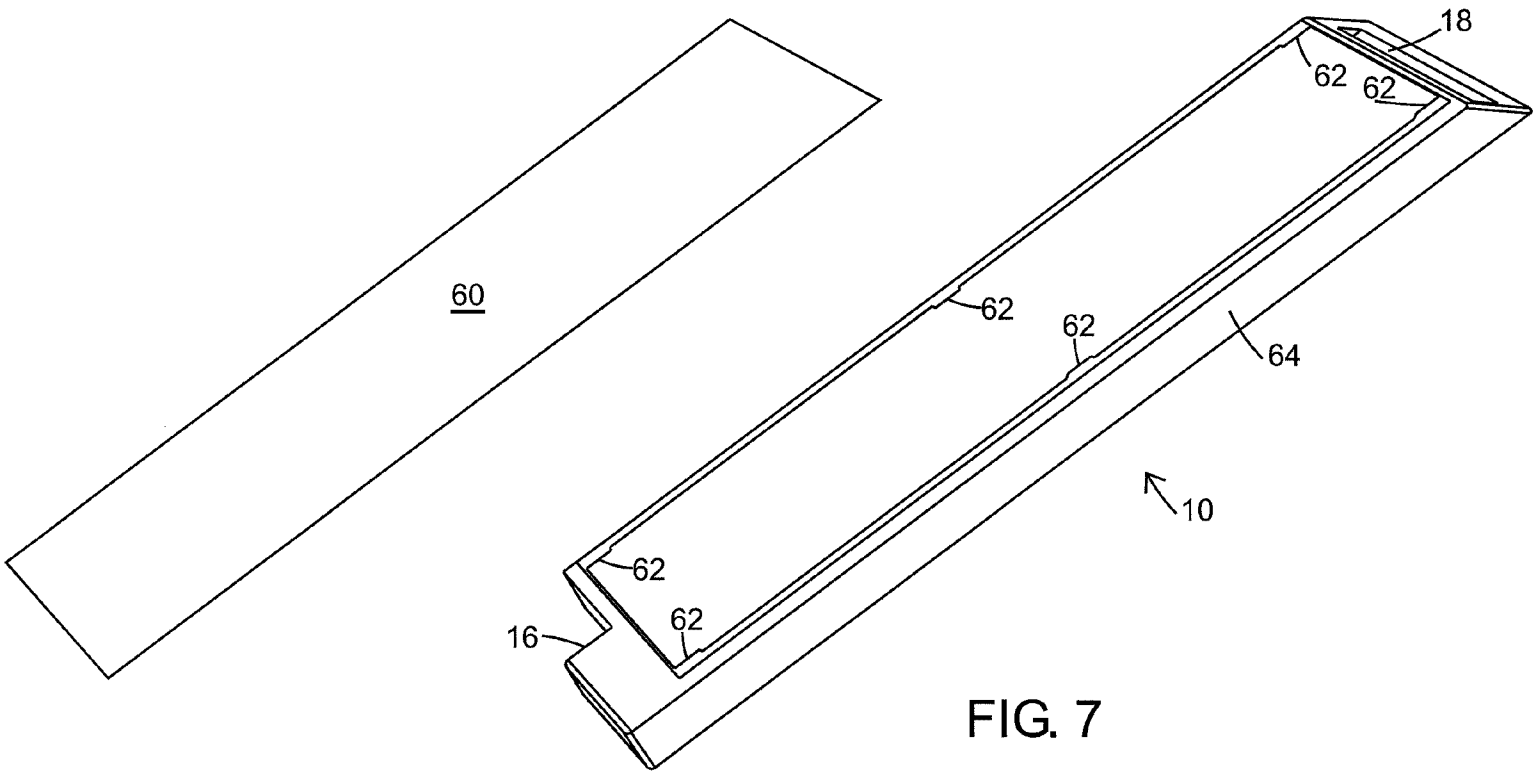
FIG. 7 is an exploded view of the pallet guard panel in FIG. 6.
Figure 8:
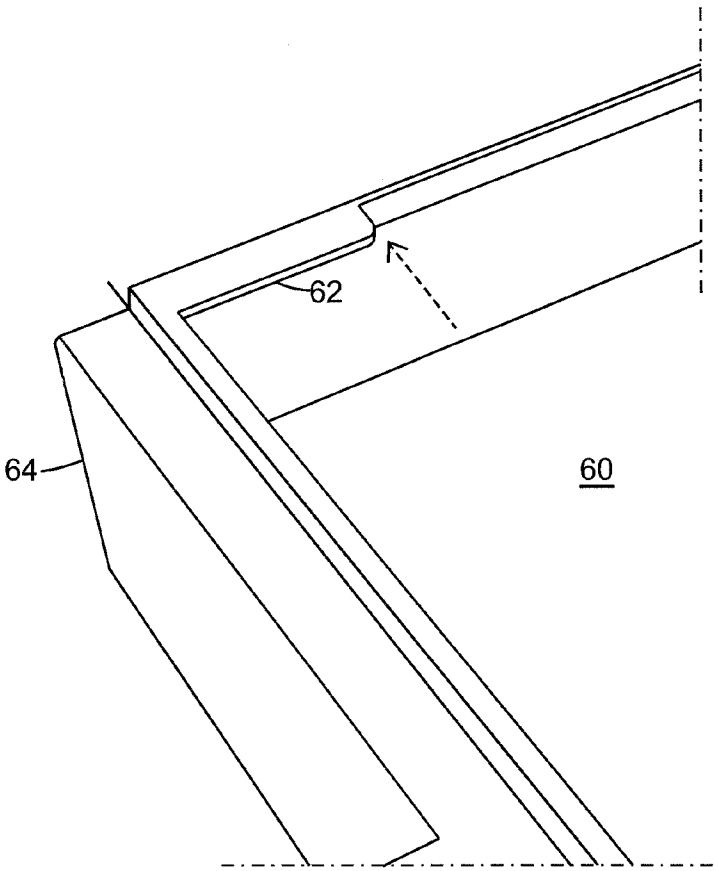
FIG. 8 is a close up view illustrating a retaining mechanism for signage according to the present invention.
Figure 9:
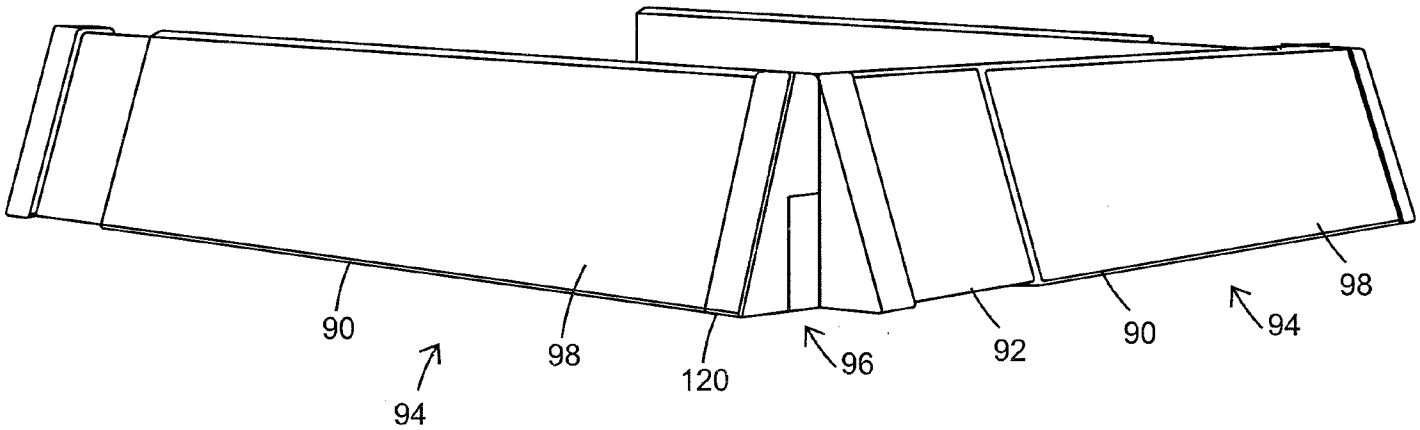
FIG. 9 is a perspective view of several assembled pallet guard panels according to another embodiment of the present invention.

Referring now to FIGS. 6-8, a second embodiment according to the present invention is illustrated with like numerals representing similar elements to those of the previous embodiment. According to this embodiment, a section 64 is similar in all respects to previously described section 12, with the exception of the configuration of the signage. Section 64 includes retainer tabs 62 for retaining a signage 60, shown to have a rectangular size and shape. In accordance with this embodiment, signages 60 need not be specially configured with tabs, but rather can take a size and shape approximately the same as that of the flat recess of section 64 and be properly retained by tabs 62. It should be apparent that any number of tabs 62 can be provided to retain signage 60 on section 64. Accordingly, signages 60 need not be precisely shaped or sized to be accommodated in the flat recess in section 64. Furthermore, if signage 60 extends across several modules including sections 64, the need for slack to permit slidable expansion of the pallet guard is greatly reduced. That is, flexible material can be provided for signage 60 to permit signage 60 to wrap around corners or across module joints while still closely fitting to the pallet guard surface and sliding within the flat recess under tabs 62.

Signage 14 and 60 can comprise any type of material suitable for display, including metal, plastic, cardboard, textile, or any other type of material that can be retained in sections 12 and 64. In addition, or alternatively, signage 14 and 60 can be secured in place with other attachment devices such as glue, screws, rivets, nails and the like. Signages 14 and 60 are designed to be removable and replaceable, but substantially non-permanent fasteners can be used to secure signages 14 and 60.

As noted above, signage 60 is preferably a flat rectangle to permit the flat recess in section 64 to support signage 60. However, signage 60 can be larger than the flat recess in section 64, so that it bulges outward or has a three-dimensional character. In this way, information on signage 60 can be arranged to be more easily observed by the shopper or viewer.

Figure 11:
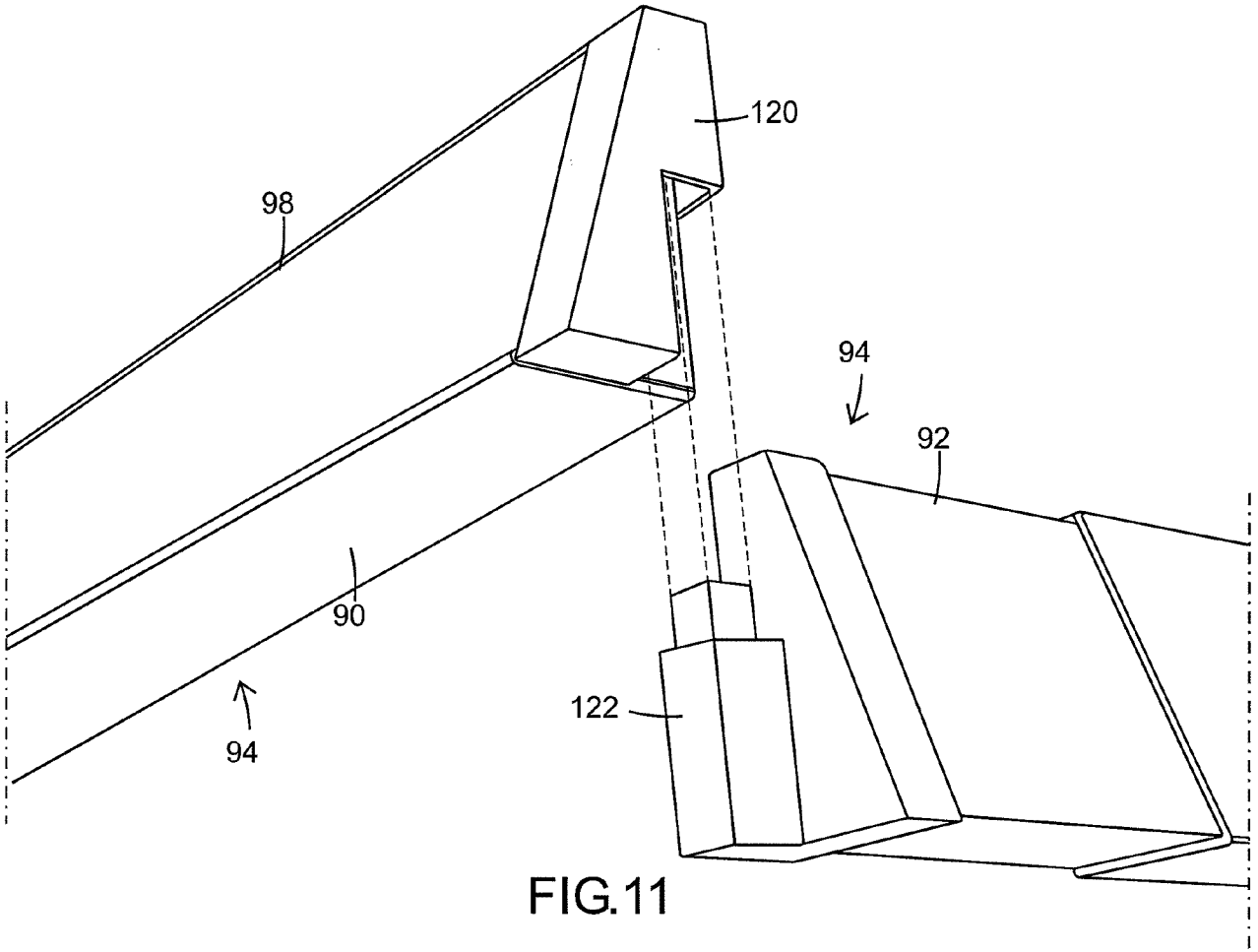
FIG. 11 is an exploded perspective view of connecting pieces of the embodiment of FIG. 9.
Figure 12:
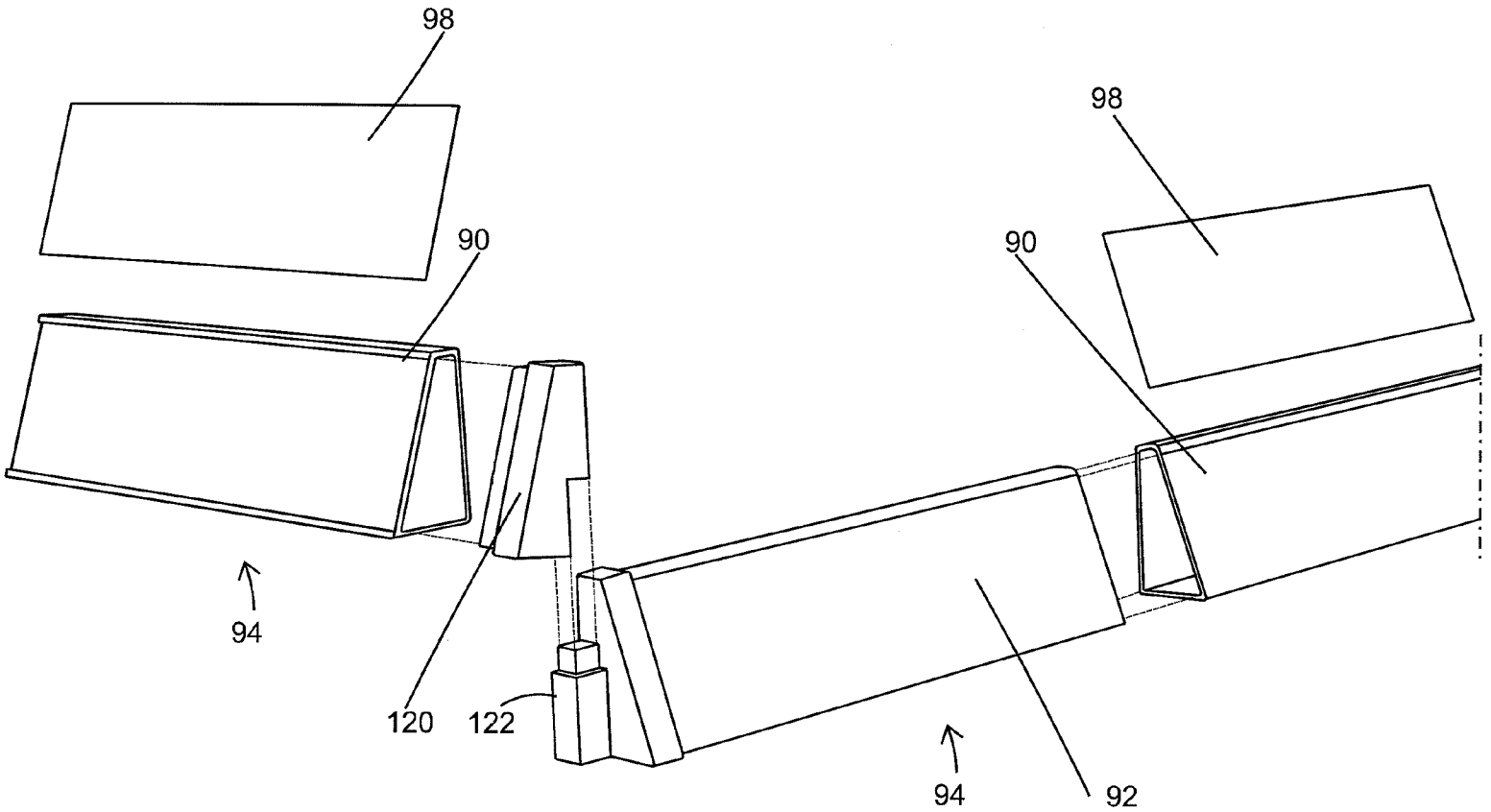
FIG. 12 is an exploded perspective view of connection components according to the embodiment of FIG. 9.
Figure 13:
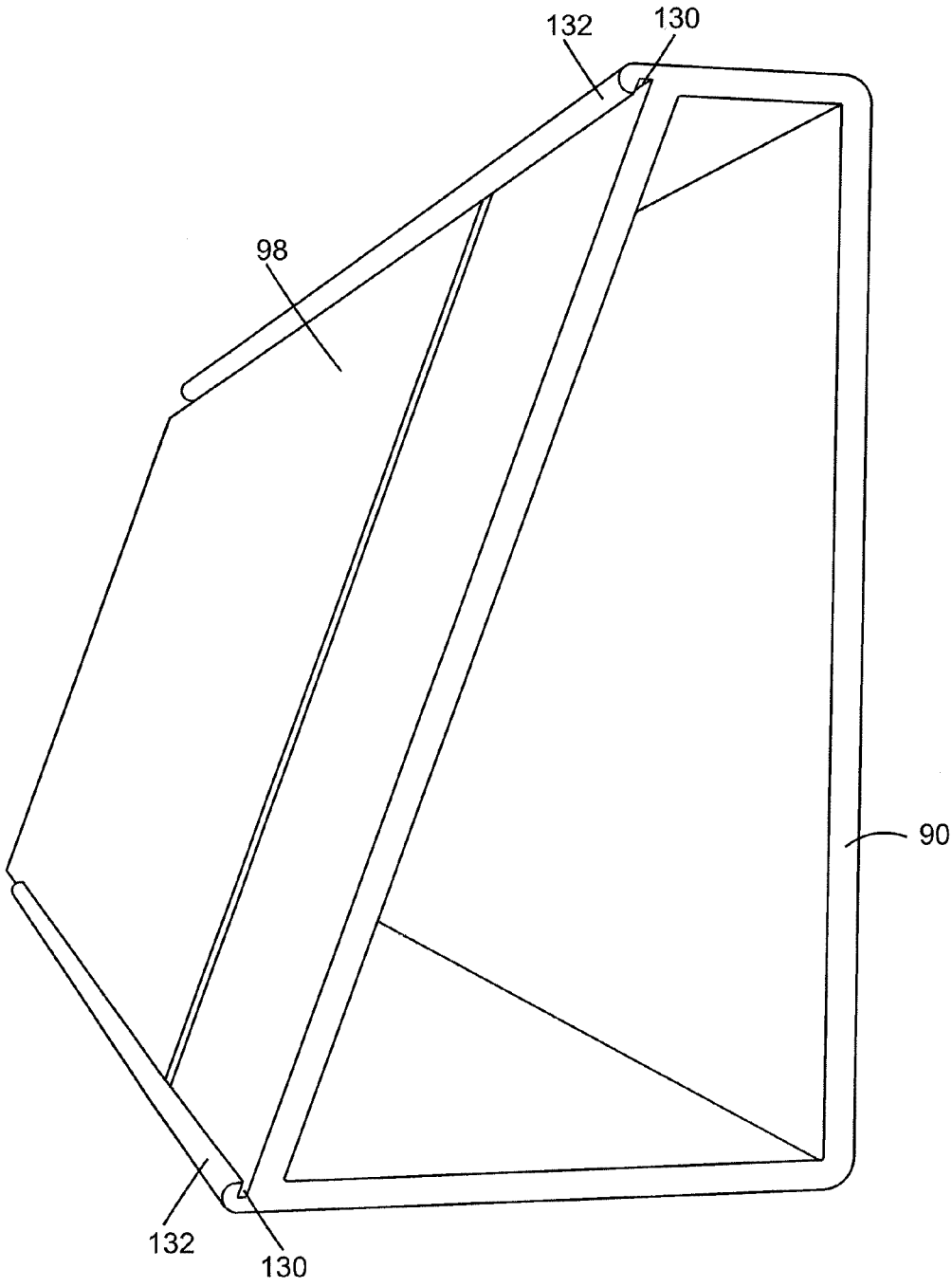
FIG. 13 is an end perspective view of an extension according to the embodiment of FIG. 9.
Figure 14:
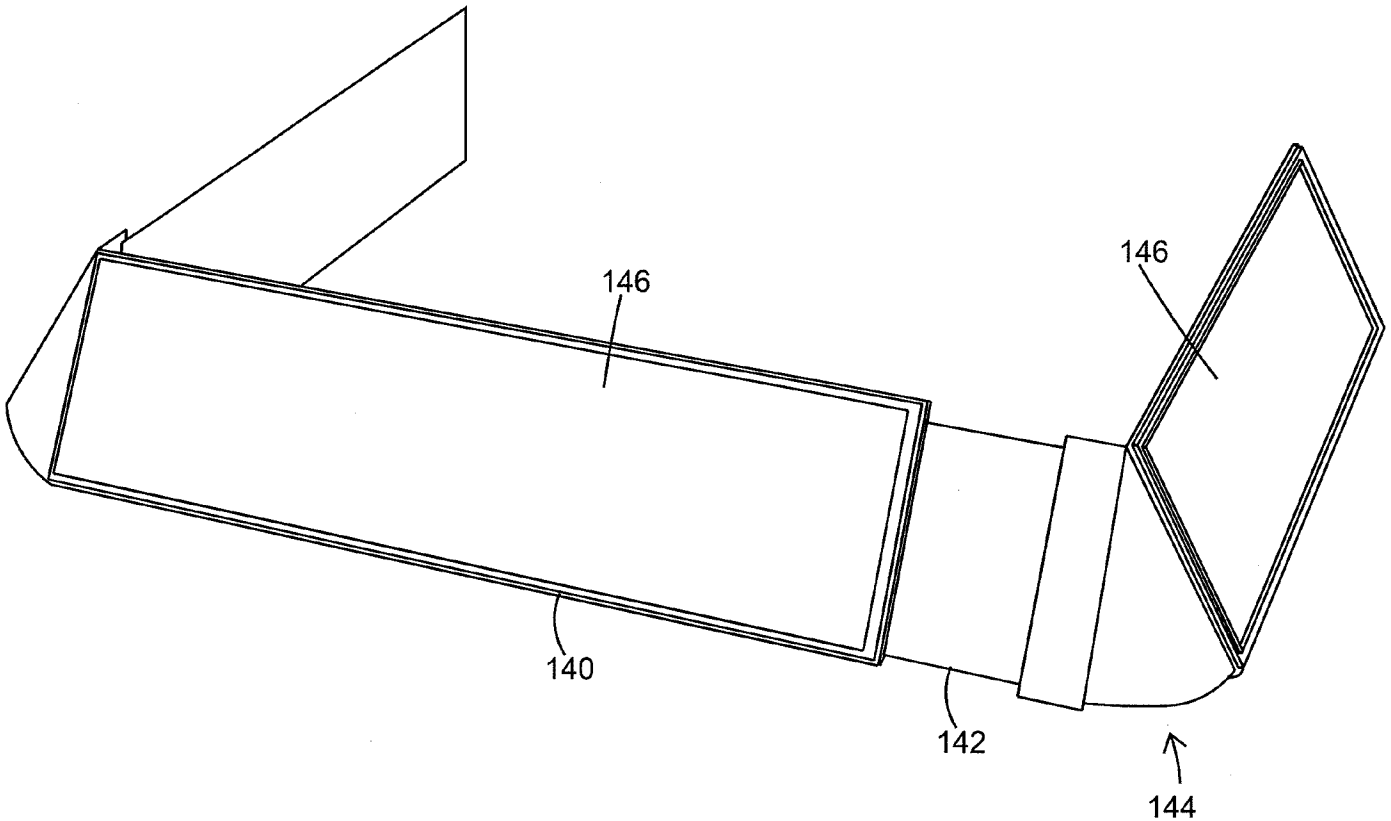
FIG. 14 is a perspective view of a pallet guard assembly according to another embodiment of the present invention.

Referring now to FIGS. 9-13, another embodiment of a pallet guard according to the present invention is shown. In this embodiment, extruded or molded sections 90 are slidable on molded panels 92, to form pallet guard module 94. Modules 94 are connected at a joint 96 to form a 90° corner for arrangement around a corner of a pallet. Alternatively, the two sections 120 and 122 (see FIG. 11) at joint 96 can be connected in-line at 180° to extend the pallet guard about multiple in-line pallets. In this embodiment, the sections 90 and 92 are made wedge shaped or triangular shaped in cross section, thus increasing the stability of the pallet guard, particularly when the pallet guard sections are coupled together in-line to protect a plurality of linearly arranged pallets. Also, in this embodiment, signage 98 is slidable within section 90, as illustrated more clearly in FIG. 13. In FIG. 13, two retaining rails 132 are shaped to form channels 130 that cooperate with an edge of signage 98 to retain signage 98 on section 90. Signage 98 can be installed in section 90 by being slid into channels 130 from an end of section 90. Alternatively, signage 98 is flexible and is installed on section 90 by placing an edge in one channel 130, slightly deforming signage 98 so that it bows outward away from section 90, and then installing the other edge of signage 98 into the other channel 130.

Referring now to FIGS. 11 and 12, assembly of two modules 94 in a 90° relationship is illustrated. A connector 120 is fitted to a section 90 to mate with a complementary connector 122 that is provided as an integral part of panel 92. The arrangement of connectors 120, 122 in cooperation provides a 90° angle connection for the pallet guard junction 96.

Figure 10:
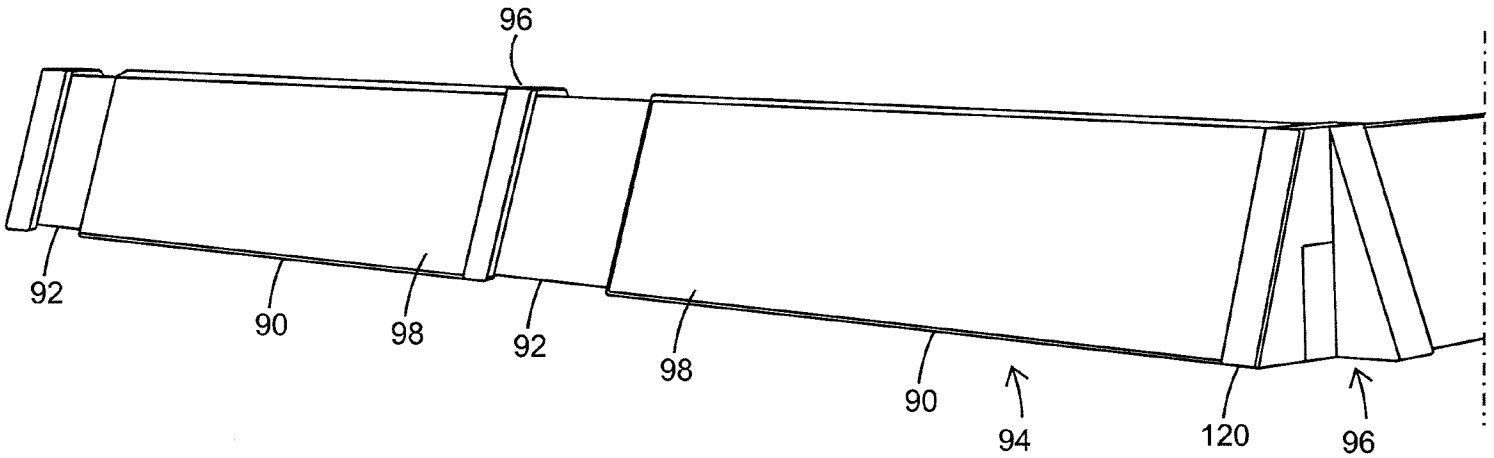
FIG. 10 is a perspective view of an assembly of pallet guard panels according to the embodiment of FIG. 9 with a straight line connection.

An extended straight line connection like that illustrated in FIG. 10 is obtained by orienting section 90 with connector 120 in line with panel 92. Connectors 120, 122 cooperate in this configuration to maintain an in-line relationship between two panels 92. Accordingly, sections 90 provide a housing for retaining connector 120, as well as receiving panel 92 in a slidable relationship to provide expansion for each pallet guard module 94.

In the embodiments of FIGS. 9-13, signage 98 is presented at an angle or slant with the vertical so that a content of signage 98 can be easily read from a number of locations, including when pallet guard modules 94 are placed on a floor. As with the previous pallet guard embodiments, signage 98 can be made to extend around a joint 96 and be received on another section 90 to form a ribbon-like display. Signage 98 can also be made to be three-dimensional, and can be comprised of multiple panels that are independent and individually removable or positioned. In addition, all of the components of the pallet guard according to this embodiment can be made of any type of material, including signage 98, although plastic or resin material is preferred for durability and ease of use.

Other advantages of the wedge or triangular shaped design include that the bottom of the pallet guard sections, by virtue of their wedge shape, extend further outward than the tops of the pallet guard sections, thus providing clearance between shopping carts and stock carts (whose chassis or wheels strike the pallet guards) and the merchandise stacked on the pallet. Additionally, because the pallet guards extend past the pallet, it is possible to allow greater overhang of the merchandise on the pallet over the pallet guard, due to the wedge-shaped design.

Figure 15:
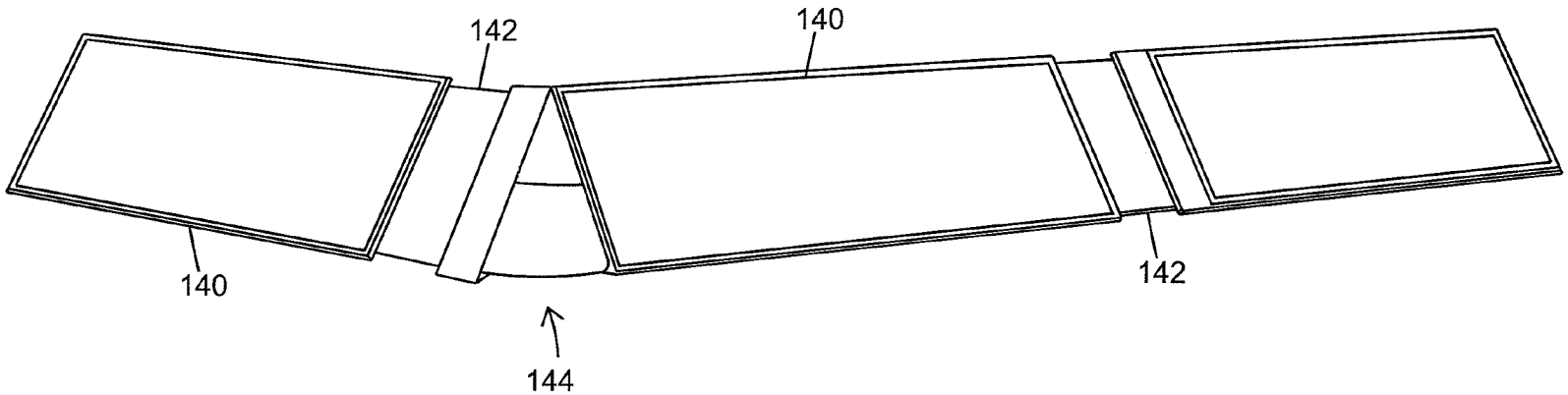
FIG. 15 is a perspective view of a pallet guard assembly with straight line extension according to the embodiment of FIG. 14.
Figure 16:
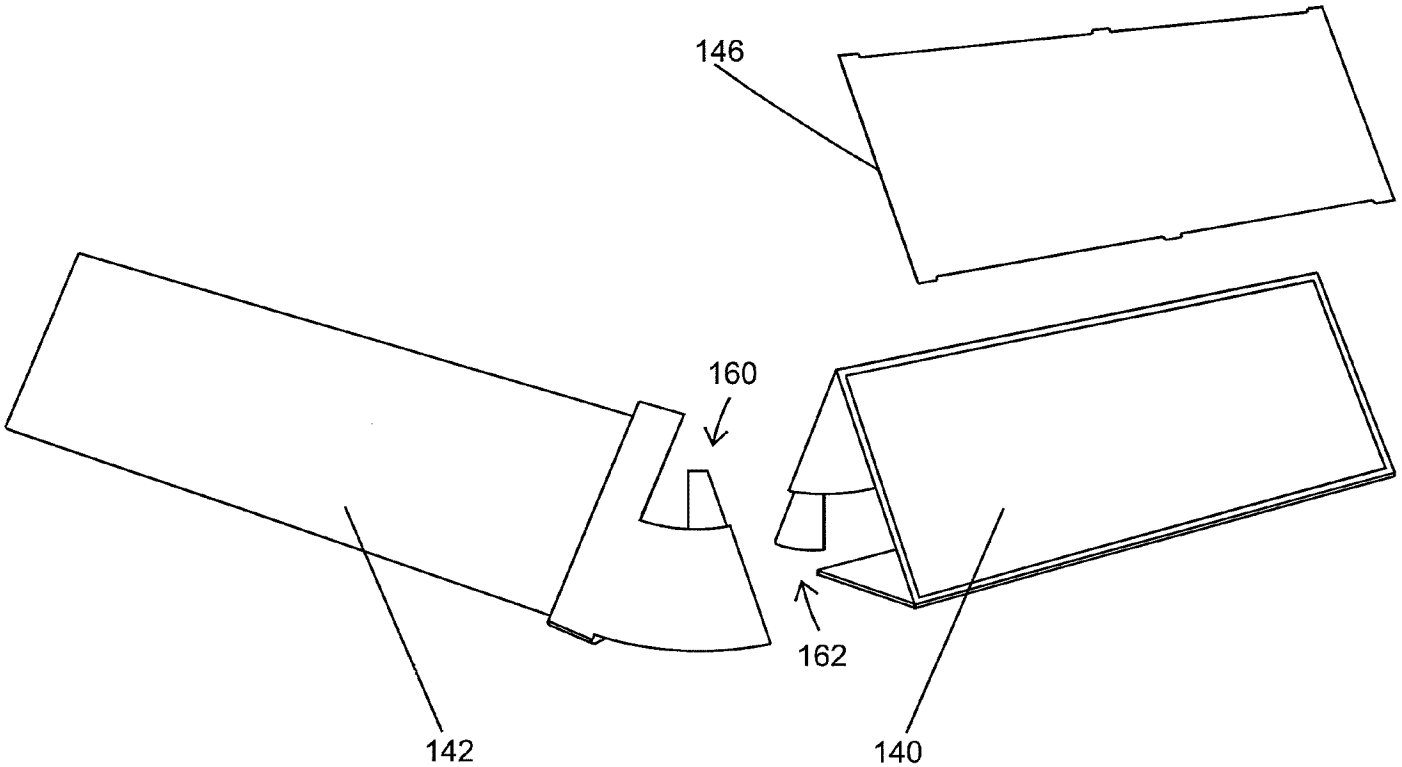
FIG. 16 is an exploded view of a joint for a pallet guard according to the embodiment of FIG. 14.
Figure 17:
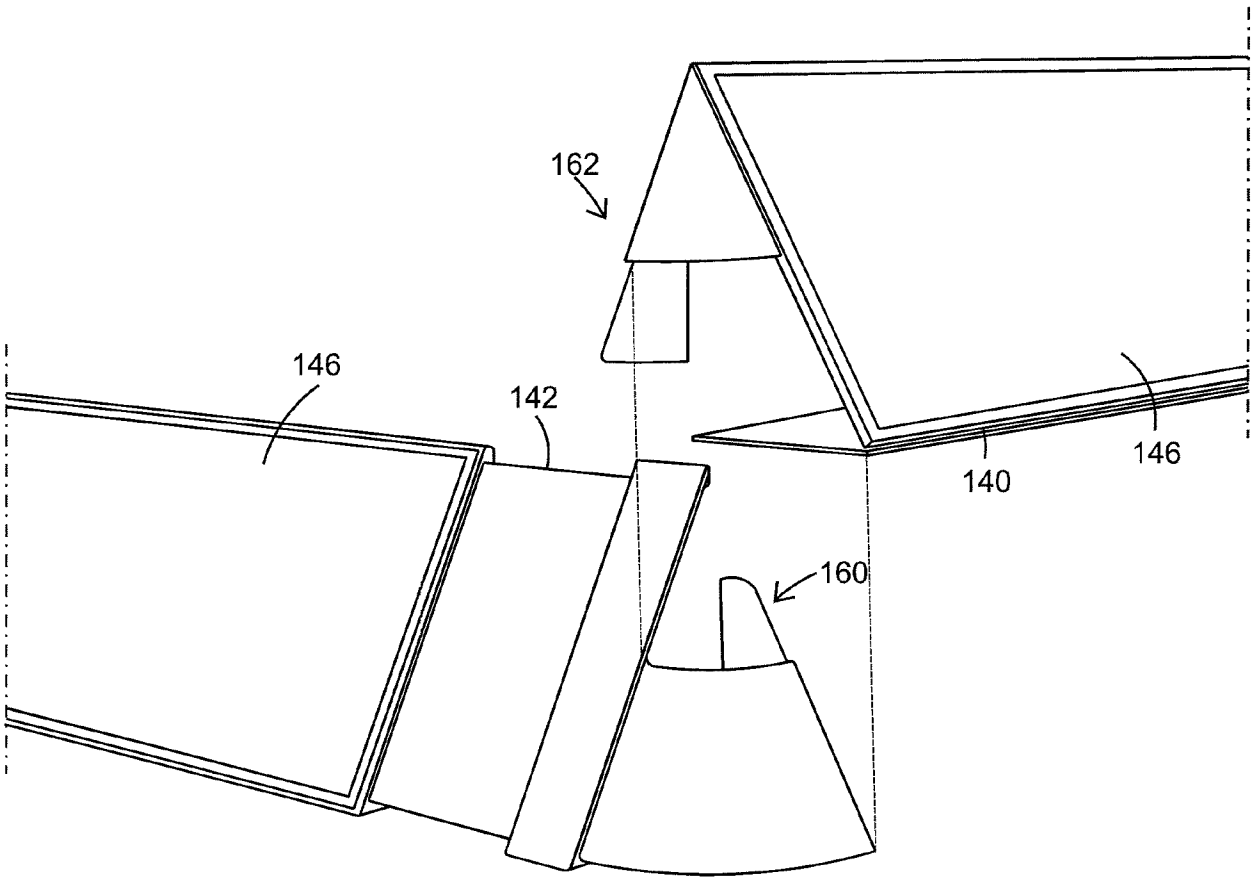
FIG. 17 is an exploded view of two connective pallet guard sections according to the embodiment of FIG. 14.
Figure 18:
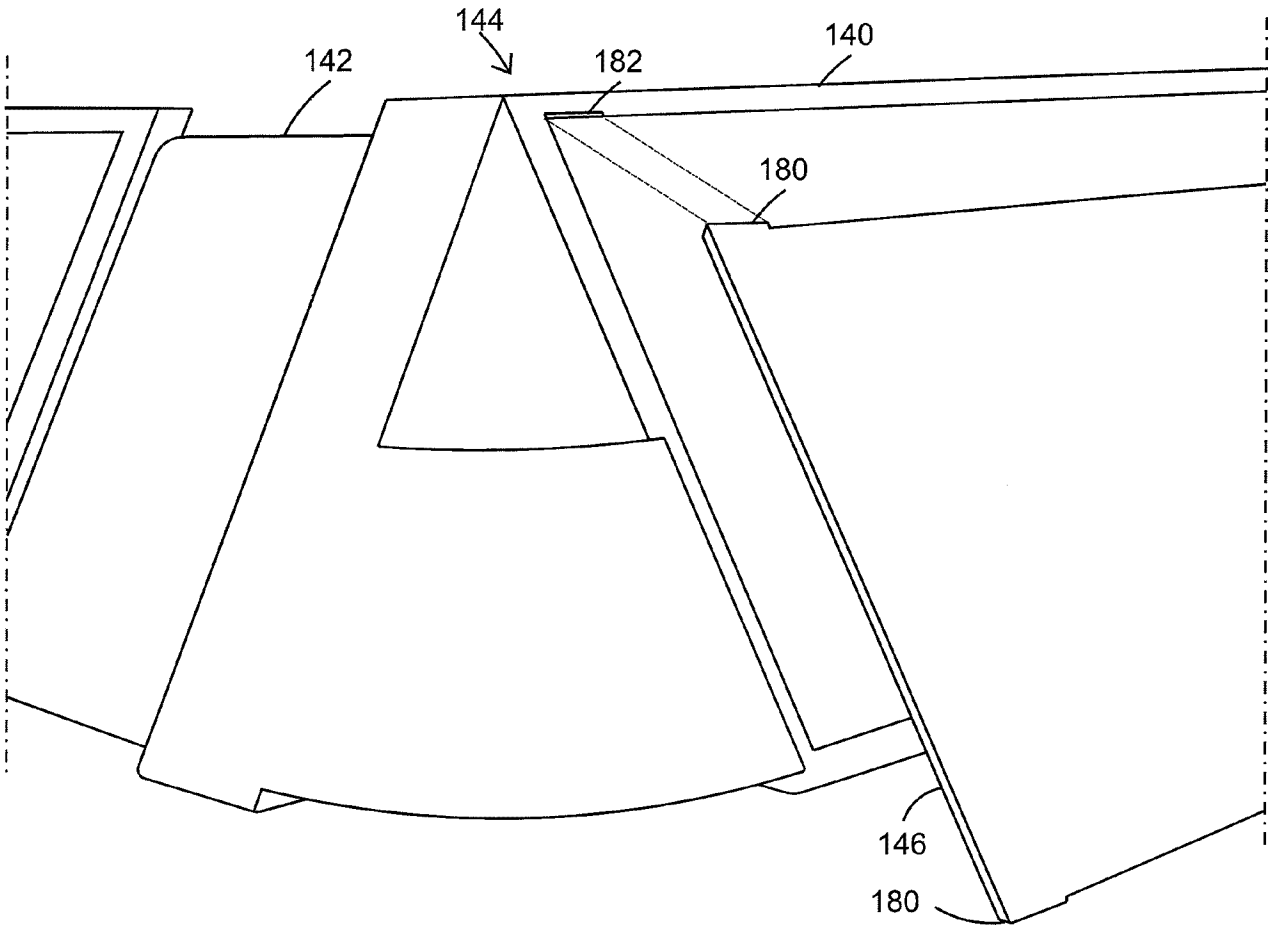
FIG. 18 is a close up perspective view of a signage attachment according to the embodiment of FIG. 14.

Referring now to FIGS. 14-18, another embodiment of a pallet guard according to the present invention is illustrated. In this embodiment, a section 140 carries signage 146 for display at an angle to the observer. A panel 142 is shaped to fit and slide within section 140 to provide extendible adjustment for a dimension of the pallet guard device. Section 140 and panel 142 each have a complementary connector 160, 162, respectively, that cooperate to couple section 140 and panel 142 together in a pivotable relationship. Connectors 160, 162 cooperate to form a pivotable joint 144 that permits section 140 and panel 142 to have an angular relationship in the range of 90° to 180° (corner connection to straight line connection). Both a straight line and corner connection relationship for joint 144 are illustrated in FIG. 15. Signage 146 may be attached to section 140 with tabs 180 that fit into notches 182 to secure the long edges of signage 146 to section 140. The relationship between tabs 180 and notches 182 is similar to that described in the first embodiment of FIGS. 1-5 and will not be repeated here. See FIG. 18. Also, other signage holding mechanisms can be employed, such as the slide-in tracks discussed later herein. However, it should be apparent that signage 146 can be made to extend around a corner including joint 144 of the pallet guard according to the fourth embodiment, such that signage 146 is retained by more than one section 140.

Figure 19:
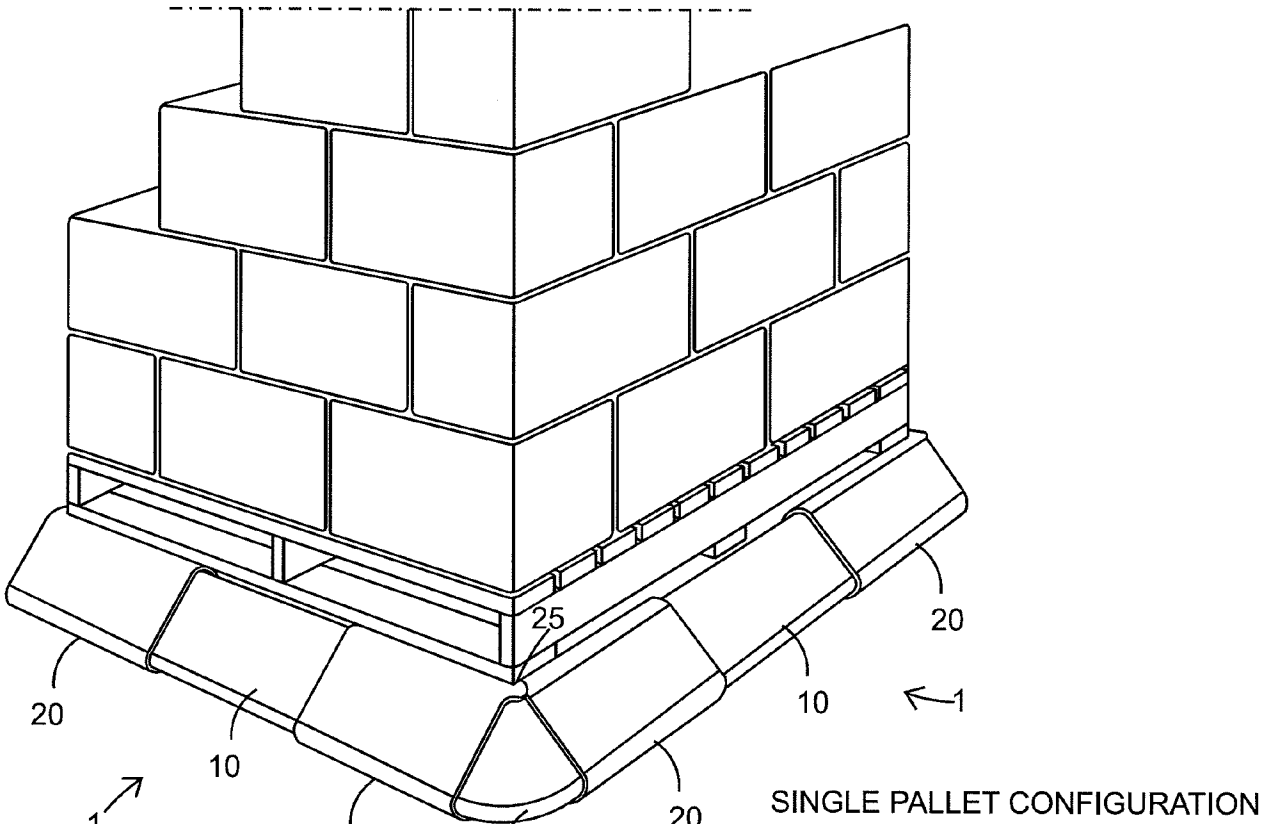
FIGS. 19-22 show another embodiment of a pallet guard.
Figure 20:
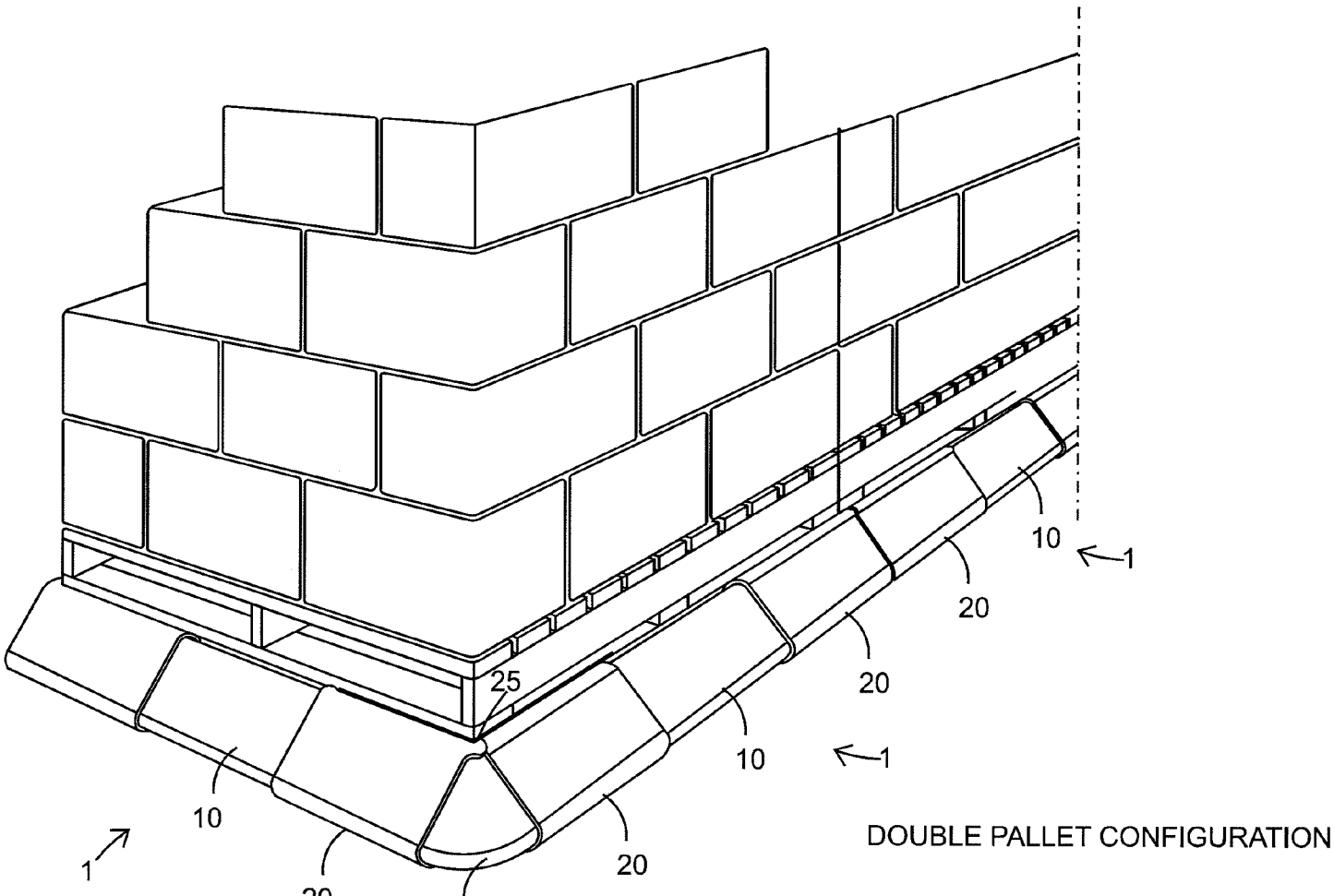
Figure 21:
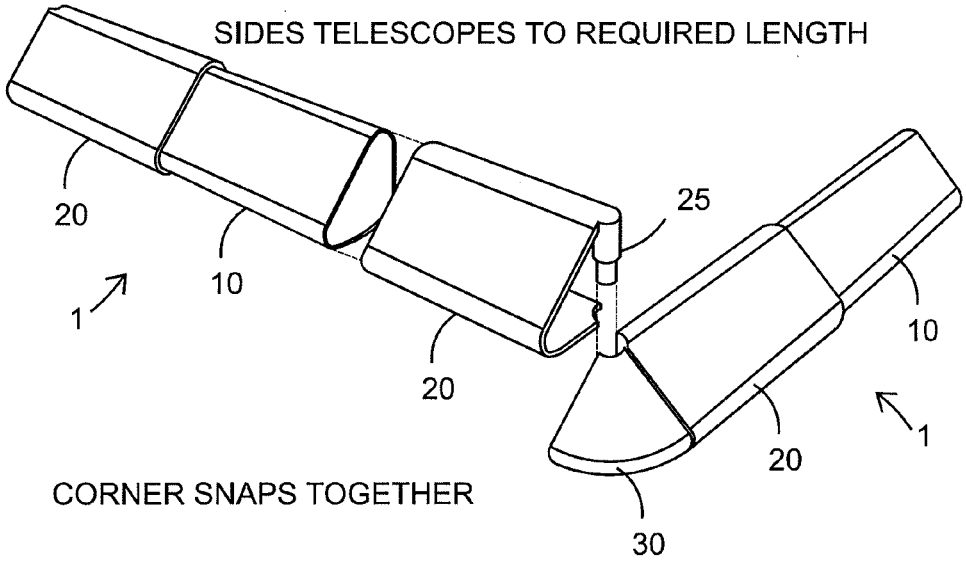
Figure 22:
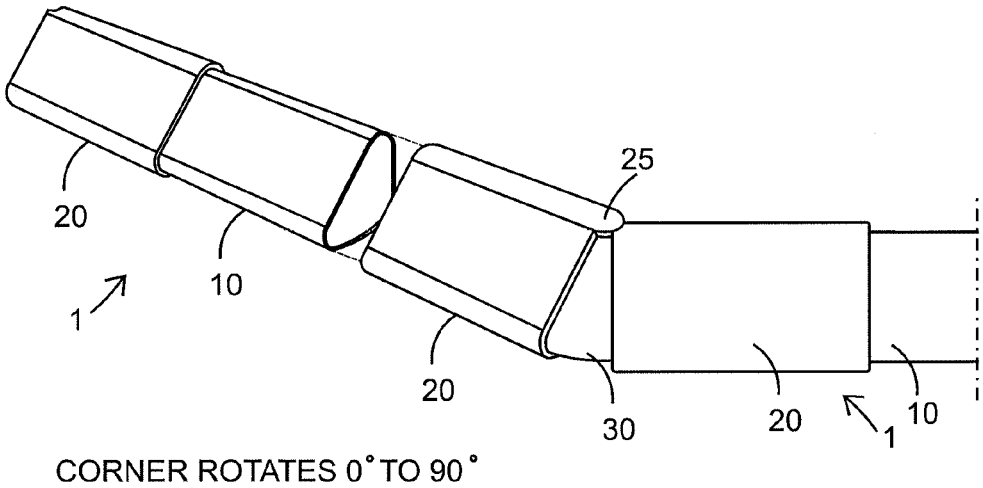

FIGS. 19-22 show another embodiment of a pallet guard according to the invention. FIG. 19 shows the pallet guard comprising pallet guard module sections 1 comprising two sections 20 and a middle section 10. The module sections 1 are coupled by a pivotable joint section 20, shown in more detail in FIGS. 21 and 22. FIG. 20 shows the pallet guard extending around a plurality of pallets, such that one of the joint sections 30 is pivoted to an in-line position. FIG. 21 shows details of the sections of the pallet guard showing how each module section 1 has a telescoping slidable inner member 10 which slides within at least one of two adjacent outer members 20 so it is adjustable to the side of the pallet. A hinge 25 is provided which is hinged at a joint section 30 which is slidable within the two adjacent members 20. The corner can rotate through an angle of 90° as shown in FIG. 22 (straight line to corner connection).

FIG. 20 shows that multiple pallets can be accommodated by setting the angle of the corner section to a straight line configuration.

Figure 23:
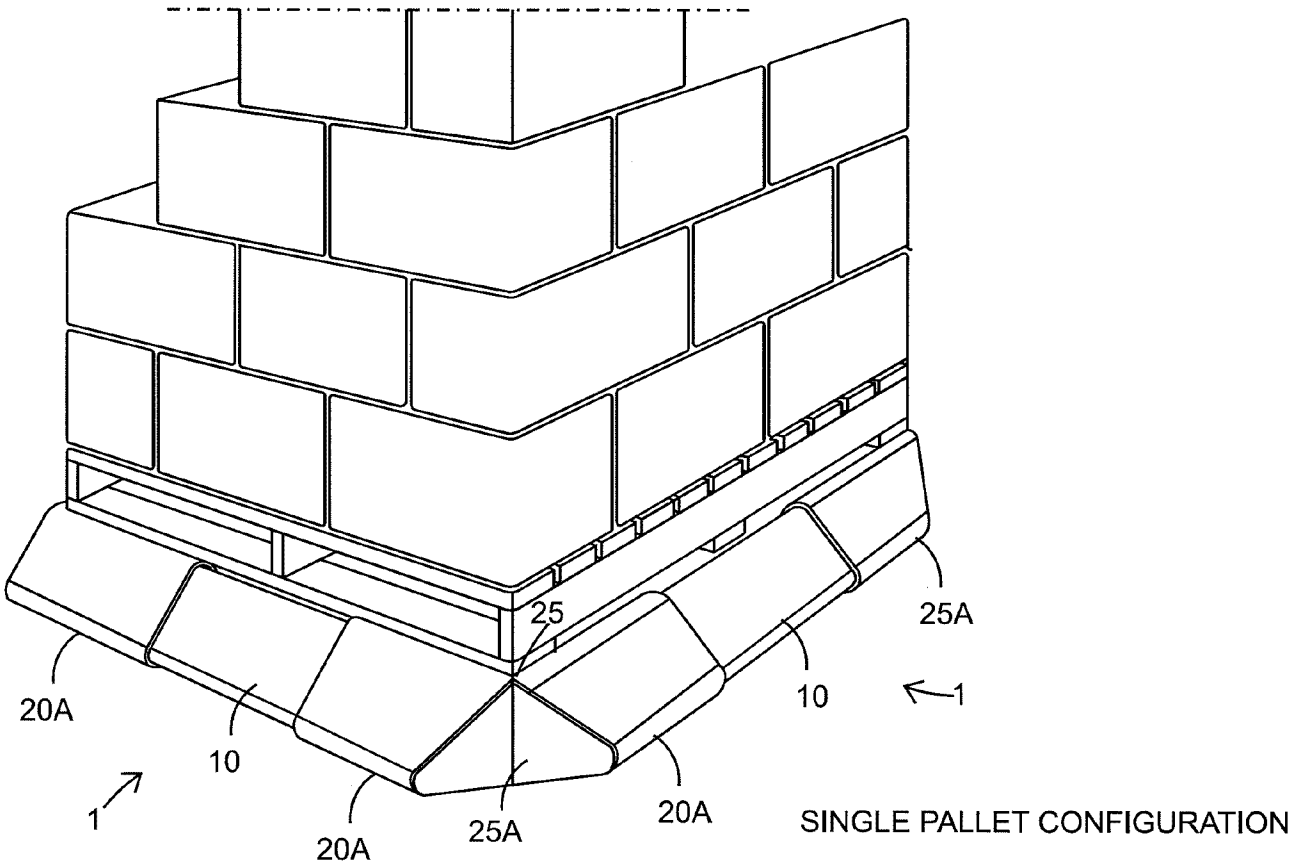
FIGS. 23 and 24 show a further embodiment.
Figure 24:
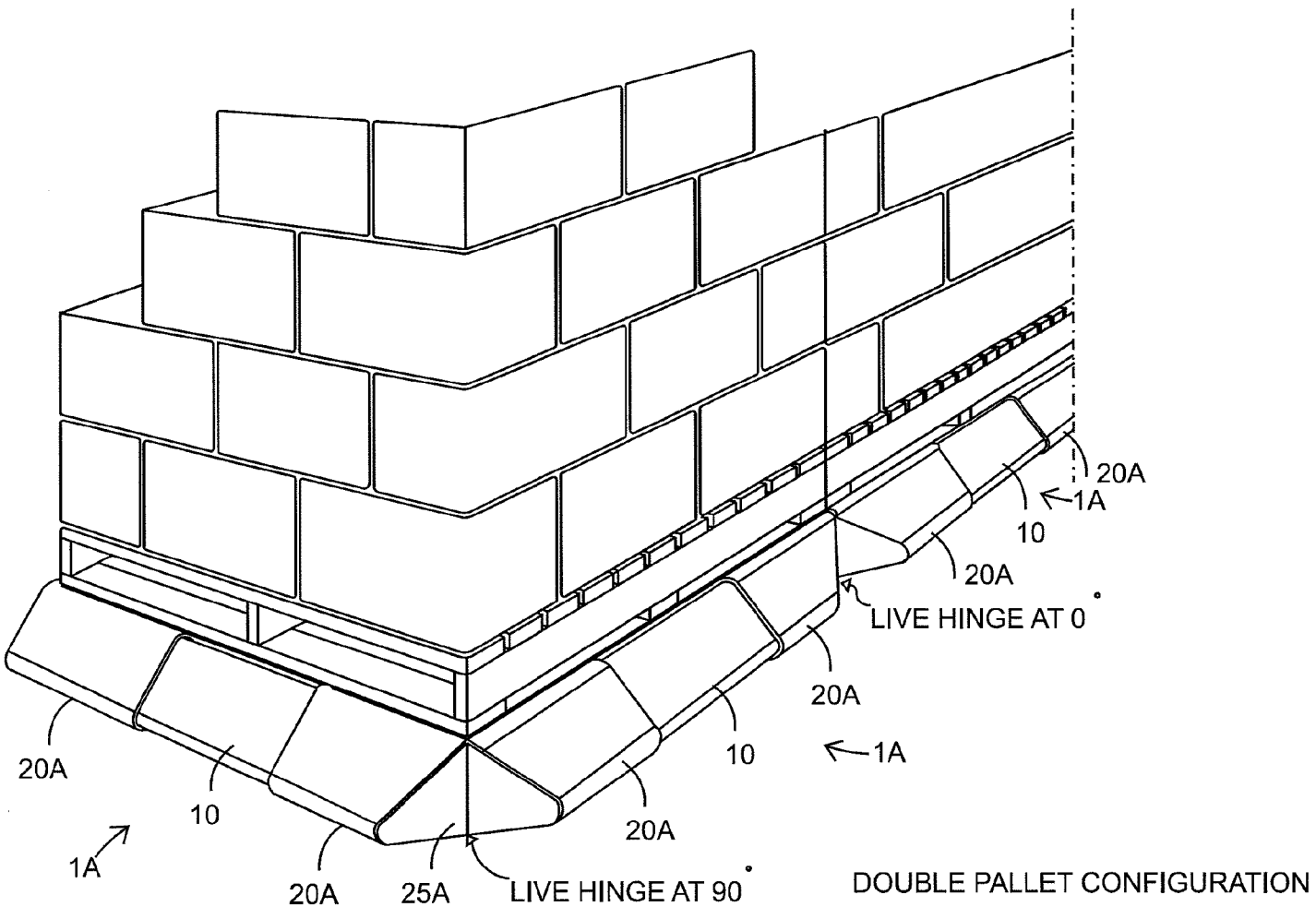

FIGS. 23 and 24 show another embodiment employing a live or molded-in flexible hinge 25A at the corner to accommodate the corner angle. FIG. 24 shows that the live hinge can be set straight to accommodate multiple pallets arranged adjacent each other.

Figure 25:
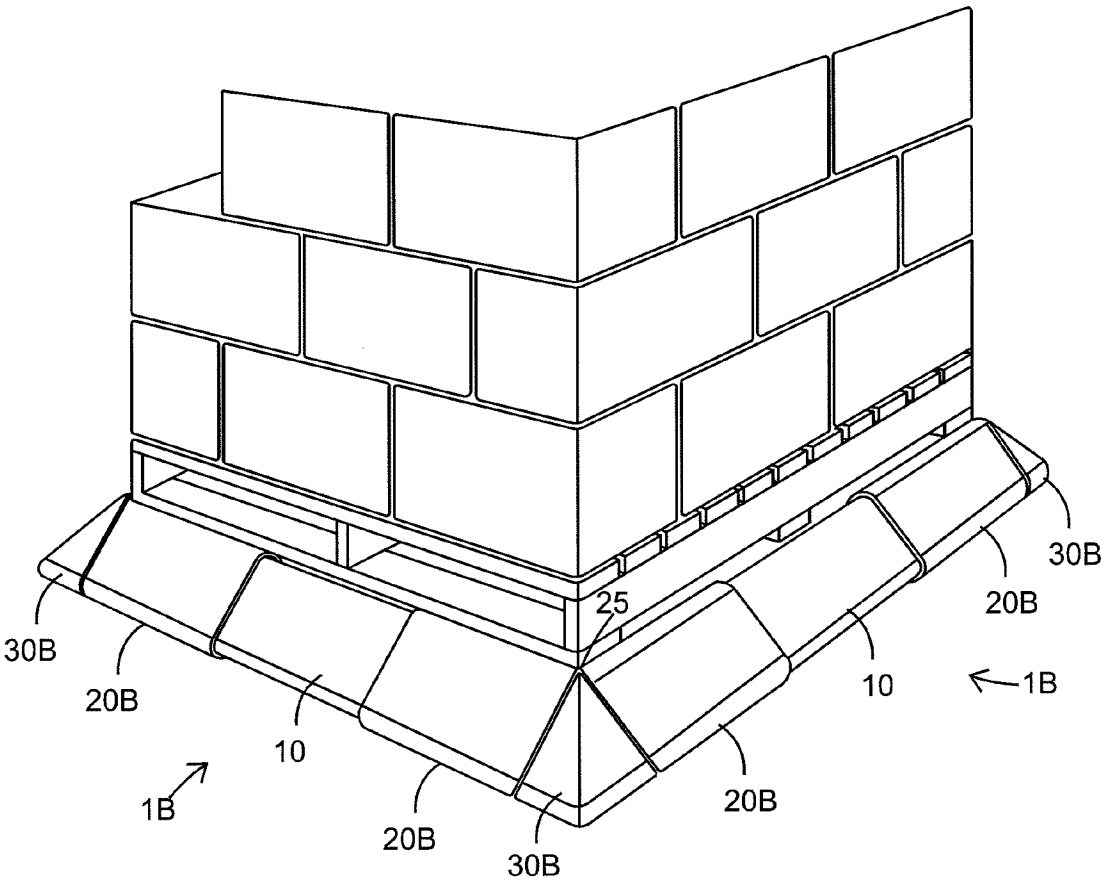
FIGS. 25-26 show yet another embodiment.
Figure 26:
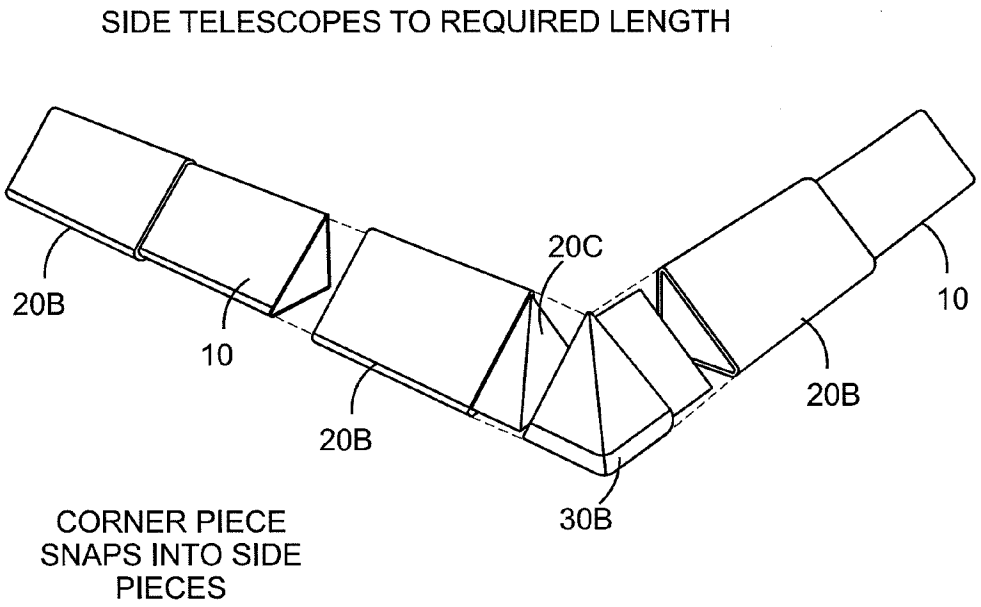

FIGS. 25 and 26 show a third embodiment having a separate fixed corner piece 30B which snaps or slides into the adjacent straight sections 1B. The straight sections 1B telescope to the required length. Should it be desired to have the pallet guard arranged in multiple adjacent pallets, the straight side sections snap or slide into each other to extend around multiple adjacent pallets. The members 20B have portions 20C (FIG. 26) onto which the corner members 30B snap or slide. The corner pieces are only used at the corners in this embodiment.

In these embodiments, the inner members 10 can be fixed to or be separated from (and slidable in) an adjacent member 20, 20A, 20B.

Figure 27:
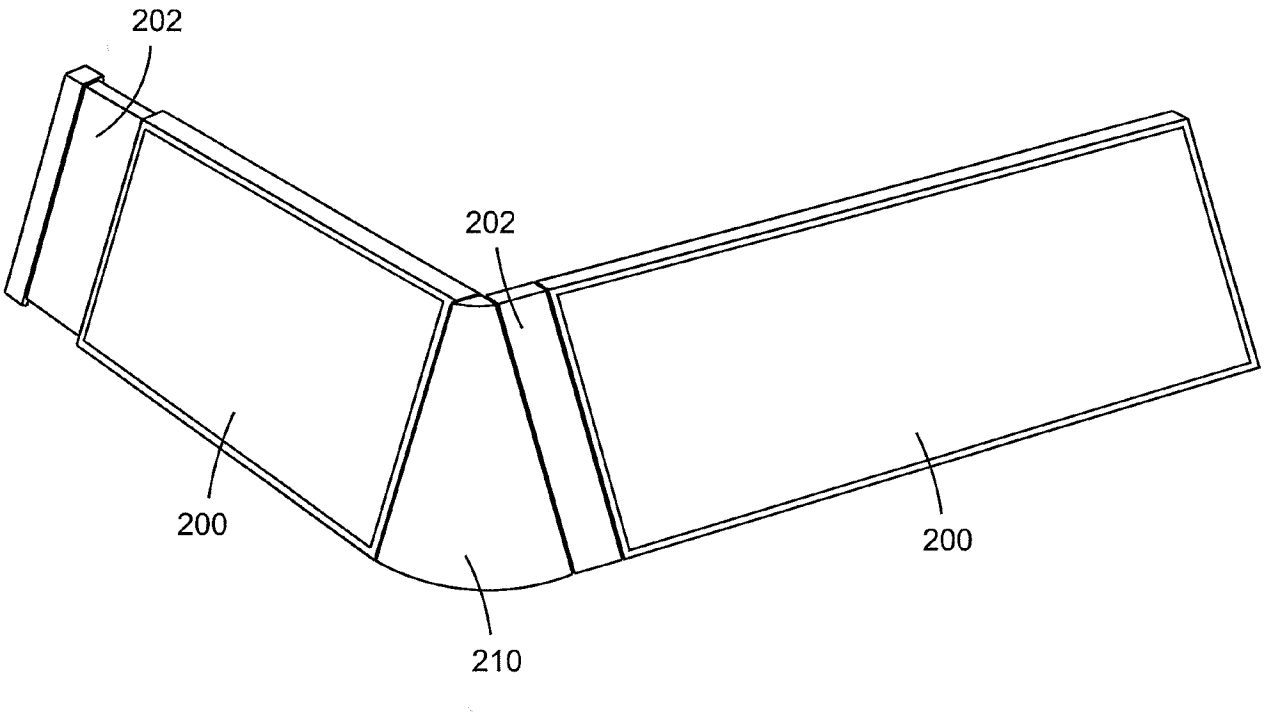
FIG. 27 shows a perspective view of a further embodiment.

FIGS. 27-42 show yet another embodiment of the invention. FIG. 27 shows two pallet guard module sections each comprising two sections 200 and 202 connected by a corner section 210. The telescoping section 202 slides in each of the sections 200.

Figure 28:
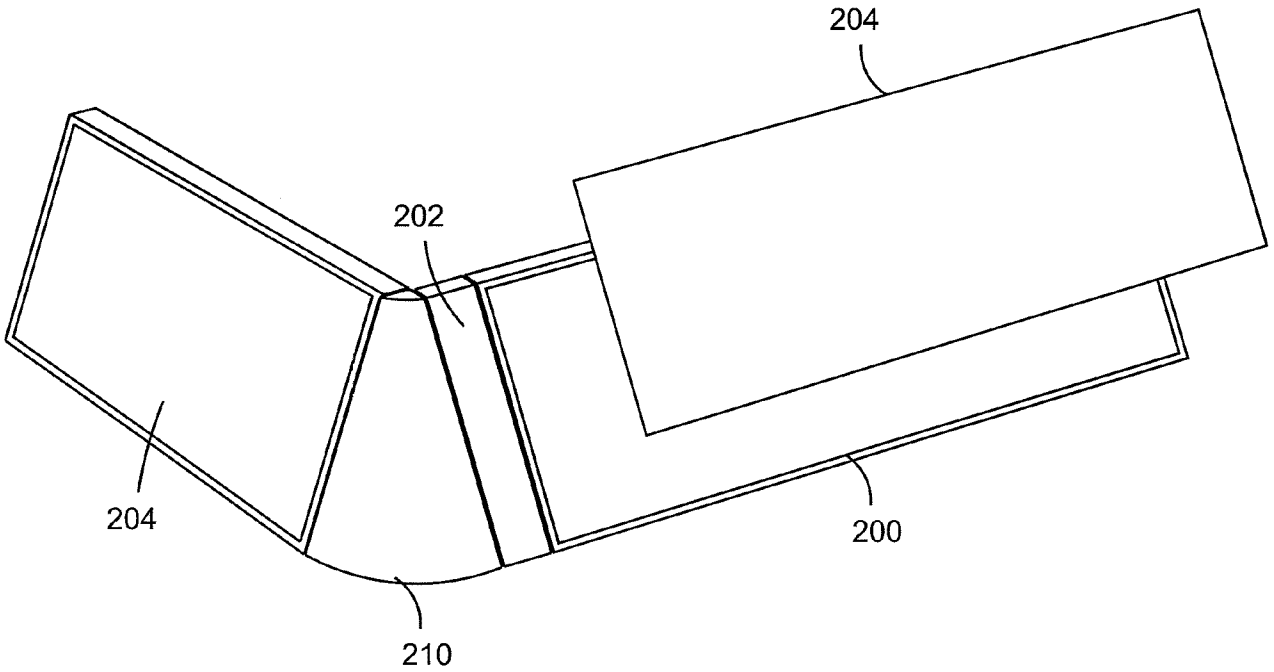
FIG. 28 shows the embodiment of FIG. 27 showing the signage removed.
Figure 40:
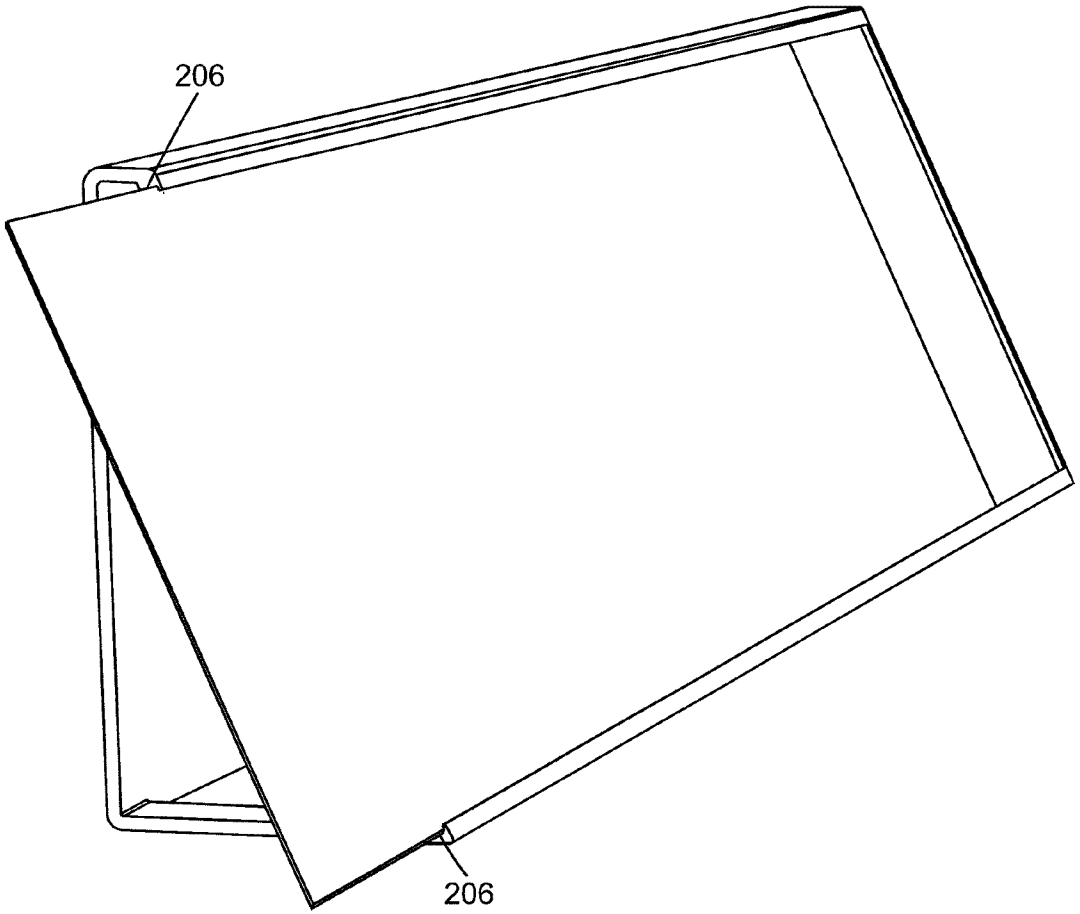
FIG. 40 shows how the signage slides into grooves of the pallet guard section.
Figure 41:
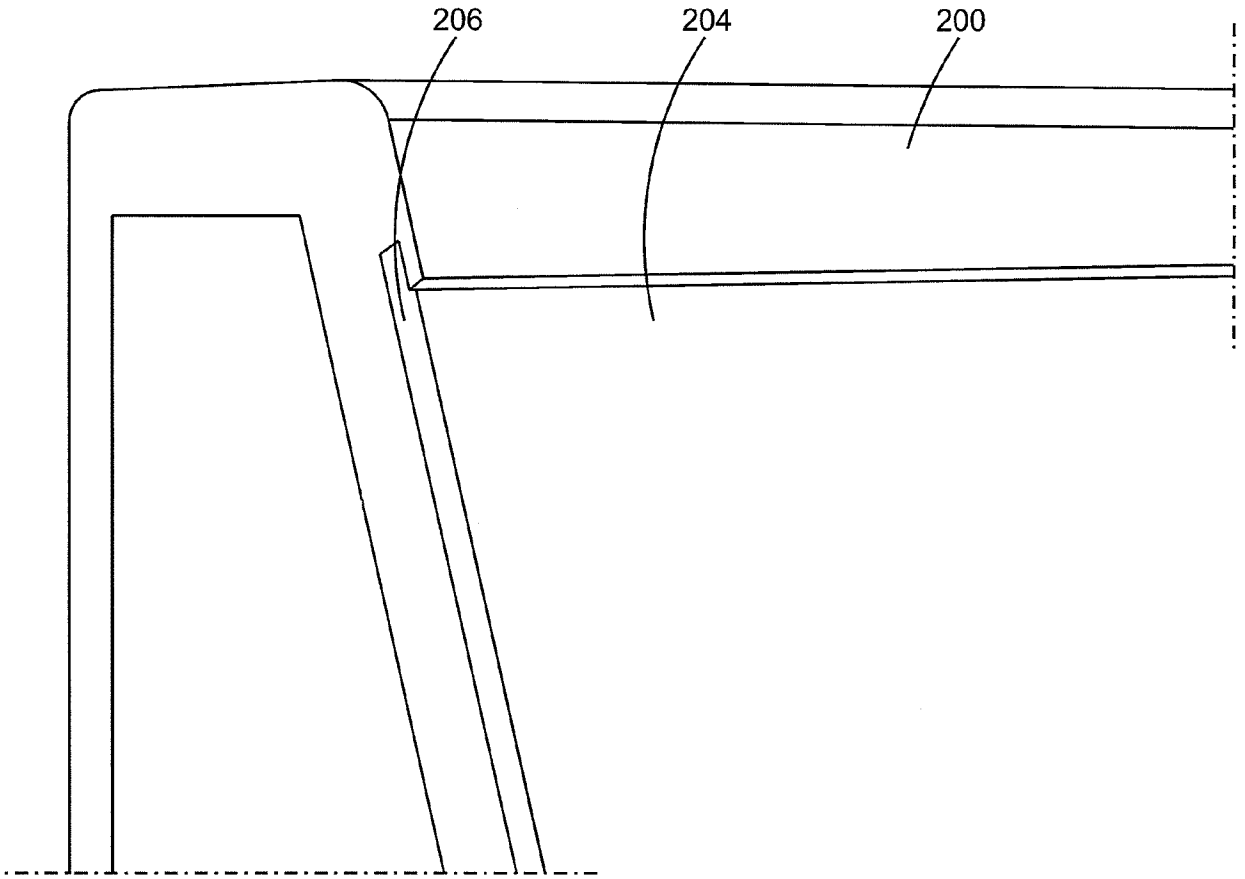
FIG. 41 shows details of the slidable signage.
Figure 42:
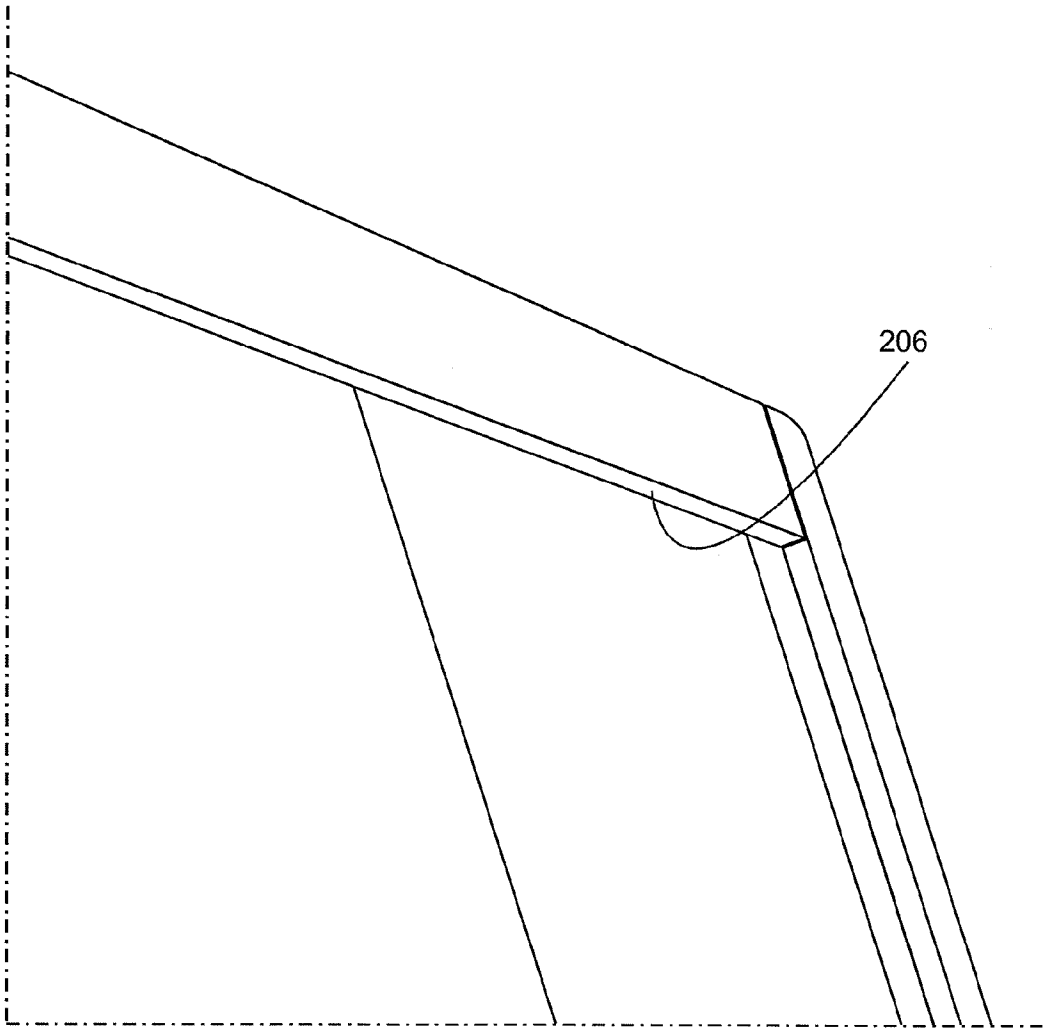
FIG. 42 shows further details of the slidable signage.

FIG. 28 shows how the signage is retained in a section 200. Preferably, as shown in FIGS. 40-42, the signage 204 is slid into channels 206 provided at the bottom and top of the triangular or wedged shaped pallet guard section 200.

Figure 29:
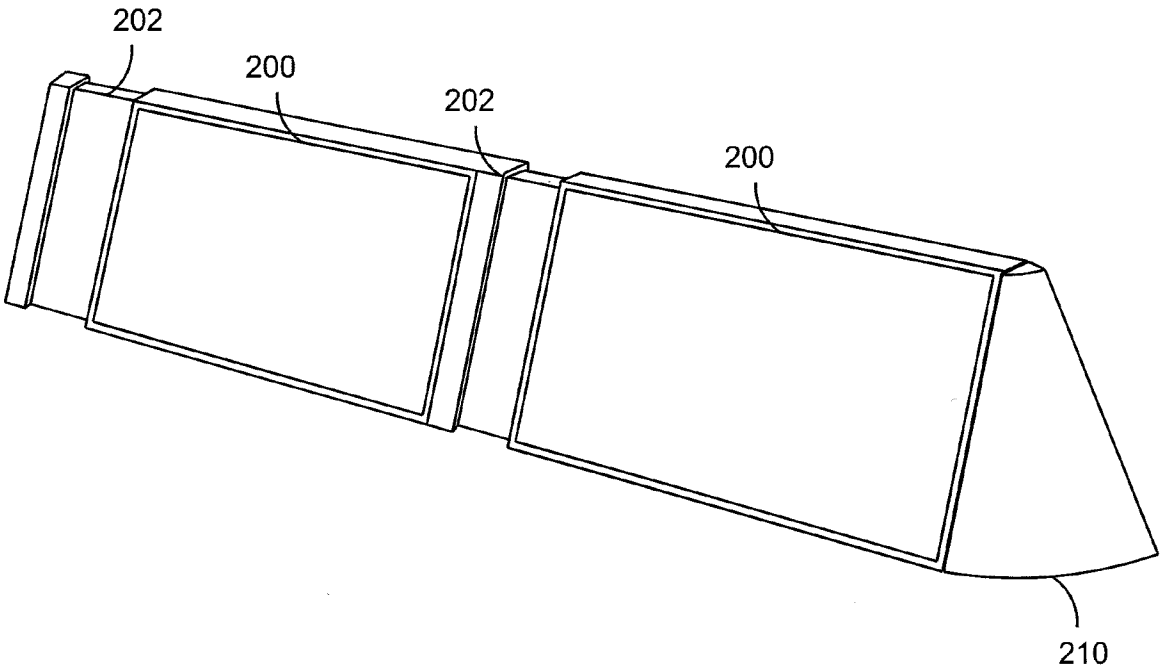
FIG. 29 shows the embodiment of FIGS. 27 and 28 arranged in a straight line connection.

FIG. 29 shows two modular sections each comprising a telescoping section 200 and 202 arranged in an in-line configuration. In arranging the modular sections in the in-line configuration, the corner section 210 is removed and section 202 couples into a complementary end connection of section 200 or stands alone in an in-line configuration.

Figure 30:
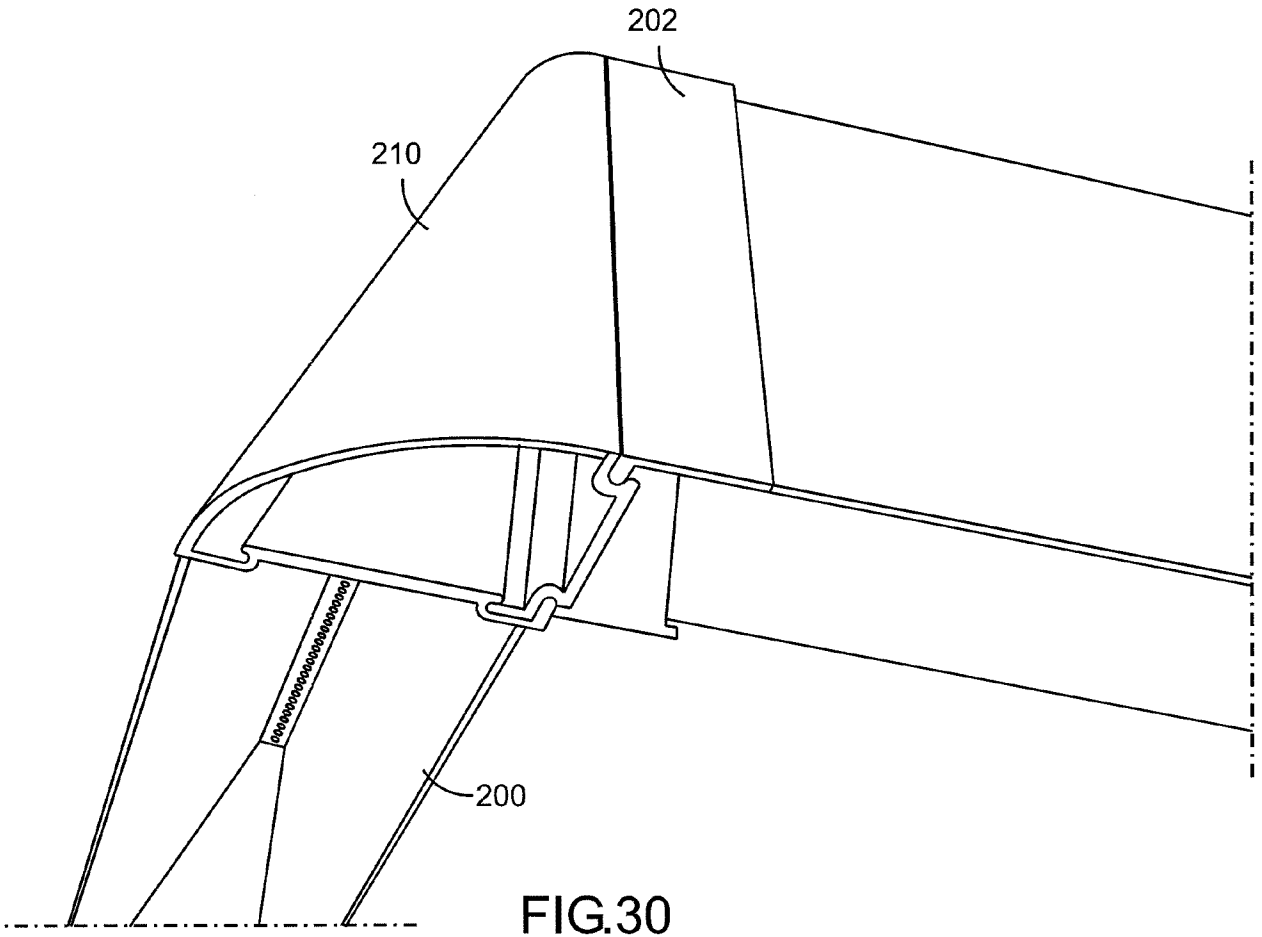
FIG. 30 shows details of the corner connection of this embodiment.
Figure 31:
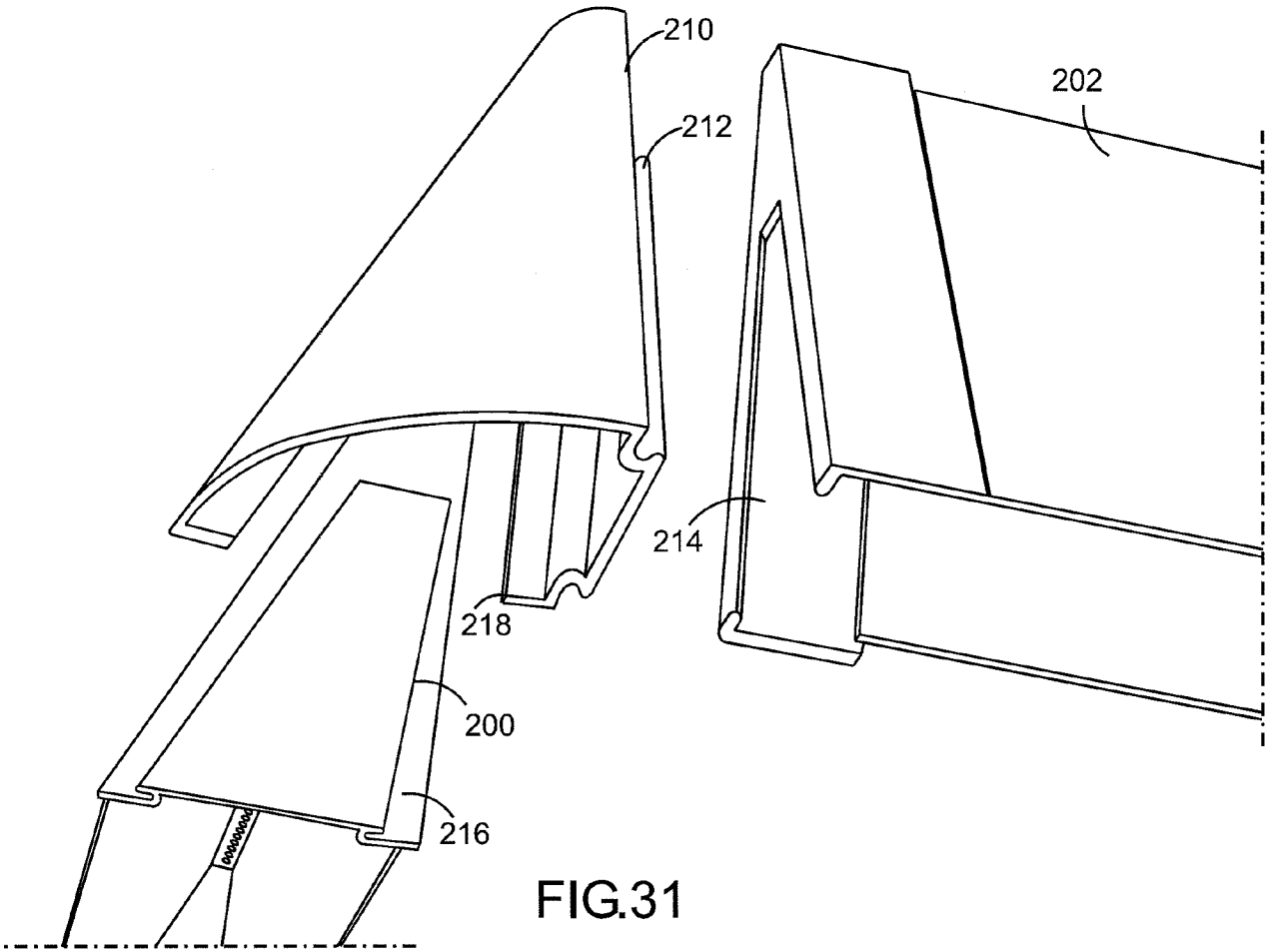
FIG. 31 shows details of the corner joint section in an exploded view.

FIG. 30 shows the corner section 210 connected to a section 202 and a section 200 to make a 90° bend. Show in more detail in FIG. 31, section 210 includes a projecting section 212 which is slidably received in a triangular shaped channel 214 of section 202. Likewise, a projecting section 216 (identical to projecting section 212) of section 200 is received in a corresponding triangular recess or channel 218 (identical to channel or recess 214) of corner section 210.

Figure 32:
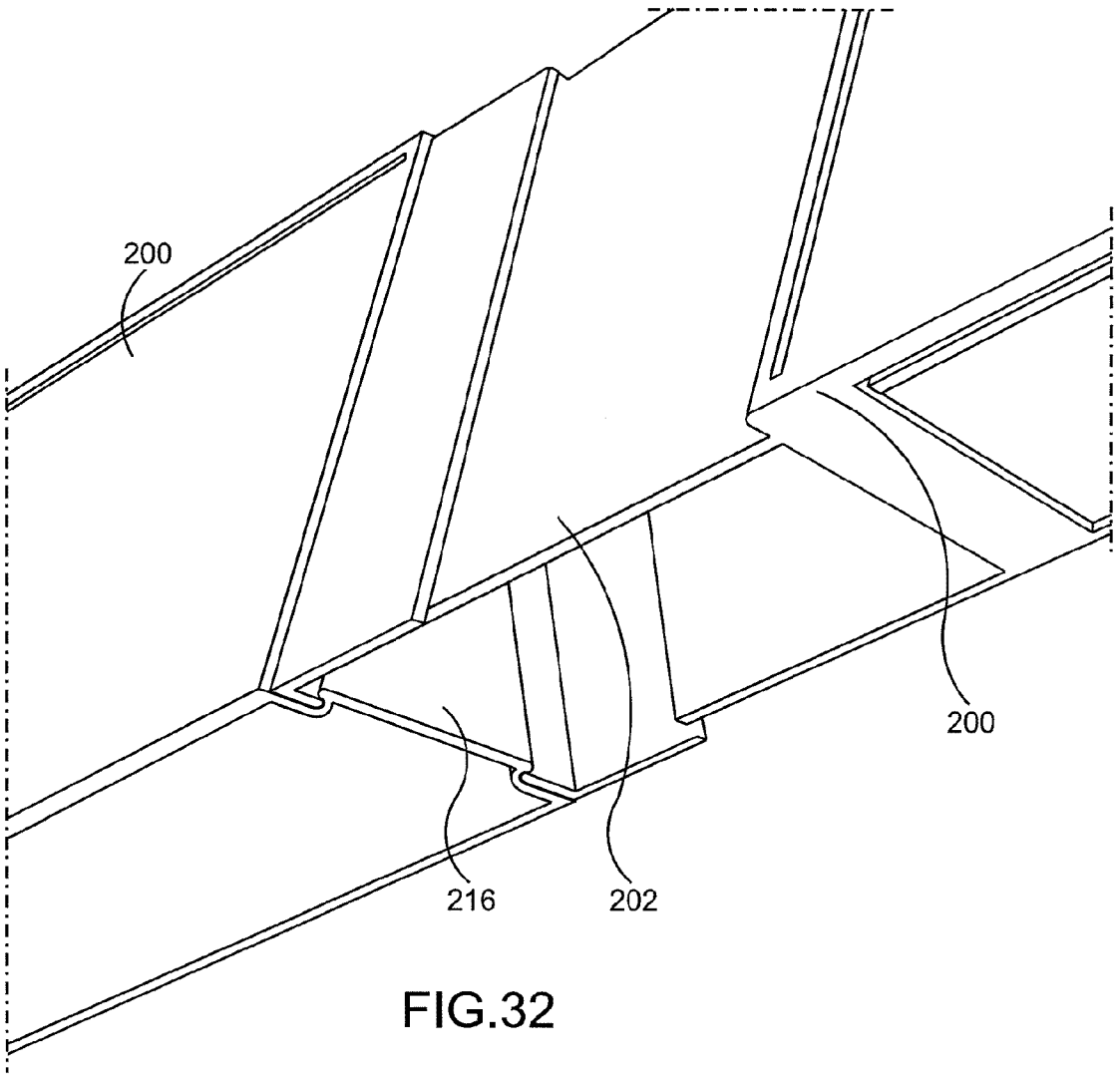
FIG. 32 shows details of how the pallet guard sections are coupled in straight line connection.
Figure 33:
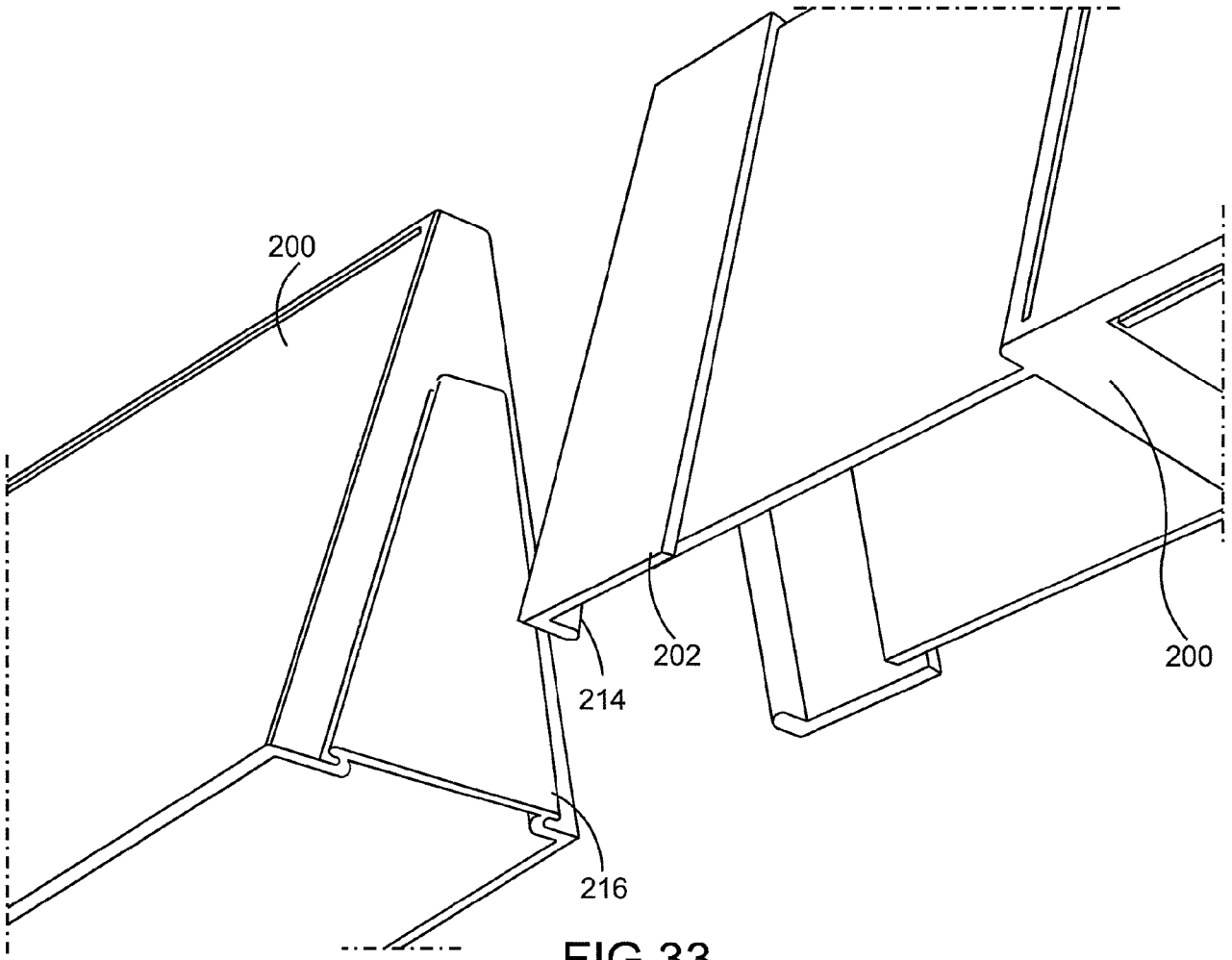
FIG. 33 shows the straight line connection of FIG. 32 in an exploded view.

FIG. 32 shows how the sections 200 and 202 are joined to make a straight in-line connection. The channel 214 is adapted to slide over the projection 216 to hold the sections 200 and 202 in an in-line connection. This is shown in an exploded view in FIG. 33. The section 210 is not used when making an in-line connection or when the pallet guard is used as a linear barrier to protect goods stored in a rack.

Figure 34:
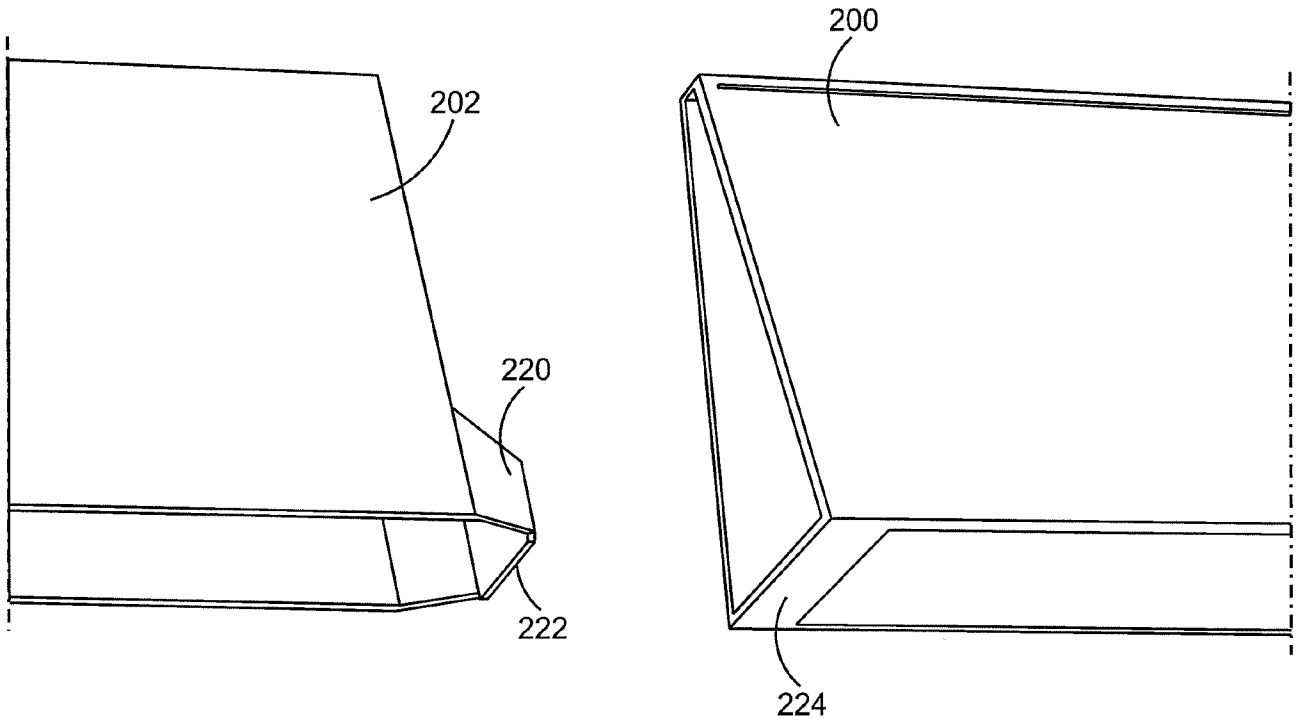
FIG. 34 shows the ends of the two telescoping pallet guard sections.
Figure 35:
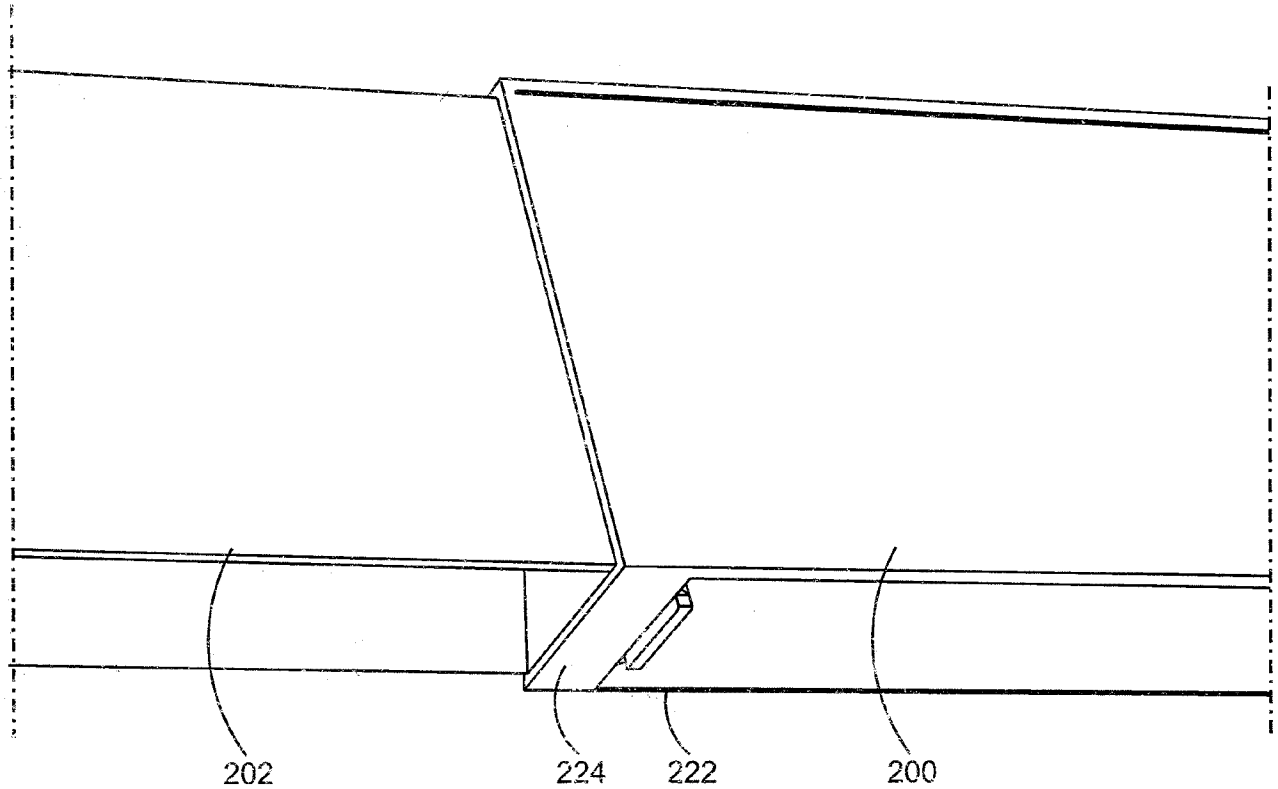
FIG. 35 shows the ends of the two telescoping pallet guard sections coupled to each other.

FIGS. 34 and 35 show how section 202 telescopes into section 200. Preferably, a projection 220 is provided at the bottom of section 202 which has a lip 222 which snaps over a bridge 224 provided at the bottom of section 200. As shown, in order to save material, the bottom of sections 200 and 202 are preferably open, with the exception of the bridge sections 224. Further, the back surface of the pallet guard section 200 and/or 202 (the surfaces facing the pallet) can be made open to save material, or can be made substantially open, with bridge like members like member 224 provided for strength and rigidity at spaced intervals.

Figure 36:
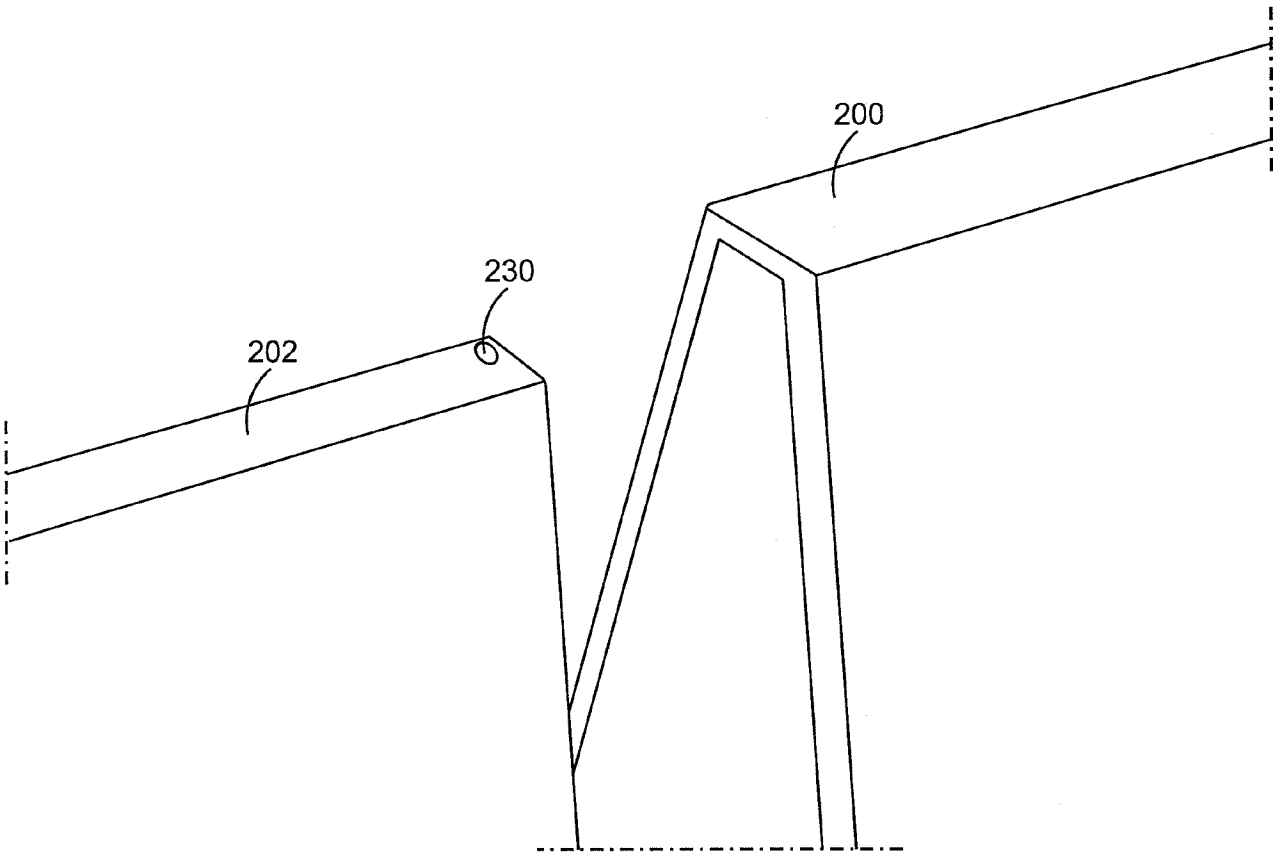
FIG. 36 shows one embodiment of a portion of a detent mechanism for holding the telescoping adjustable pallet guard sections at a desired length.
Figure 37:
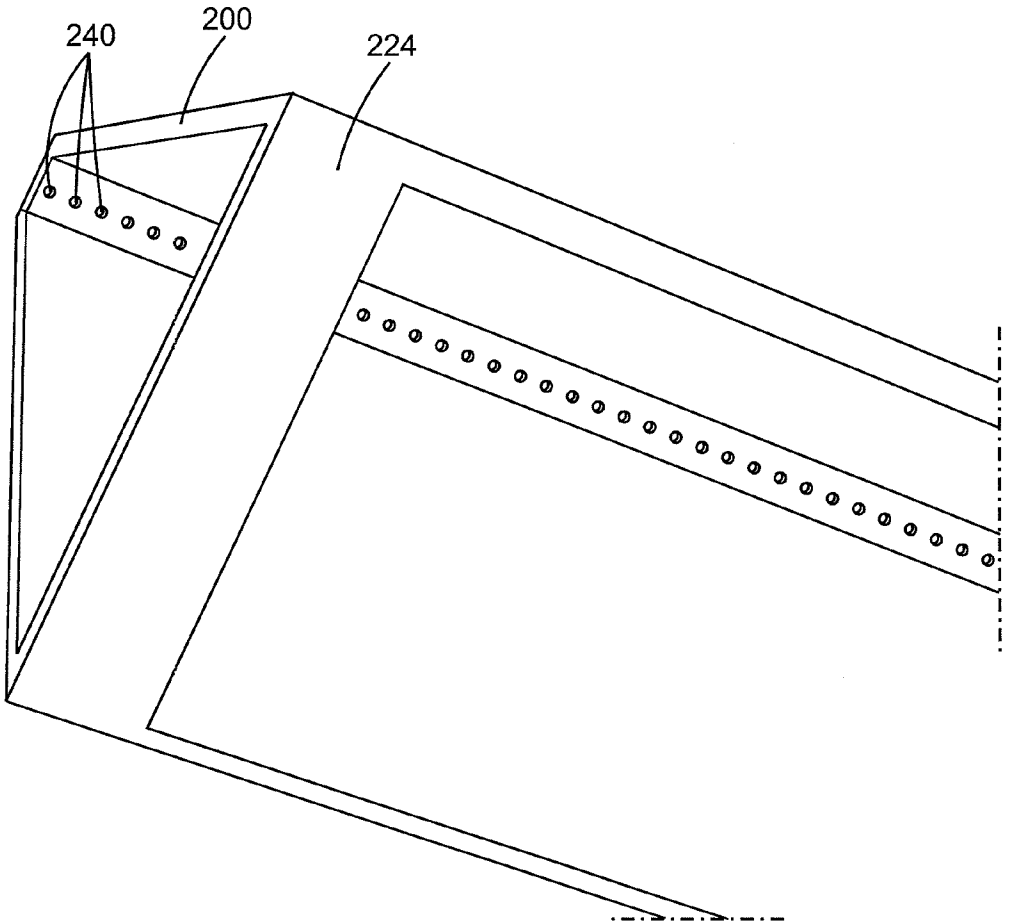
FIG. 37 is a view showing a portion of the detent mechanism.

FIGS. 36 and 37 show that a detent means can be provided to hold the sections 200 and 202 in a semi-fixed, adjustable position with respect to each other. As shown, the detent mechanism can include a small bead-like projection 230 at the top face of section 202 which engages with one of a plurality of recesses 240 arranged in the underside of the top of section 200, shown in FIG. 37.

Figure 38:
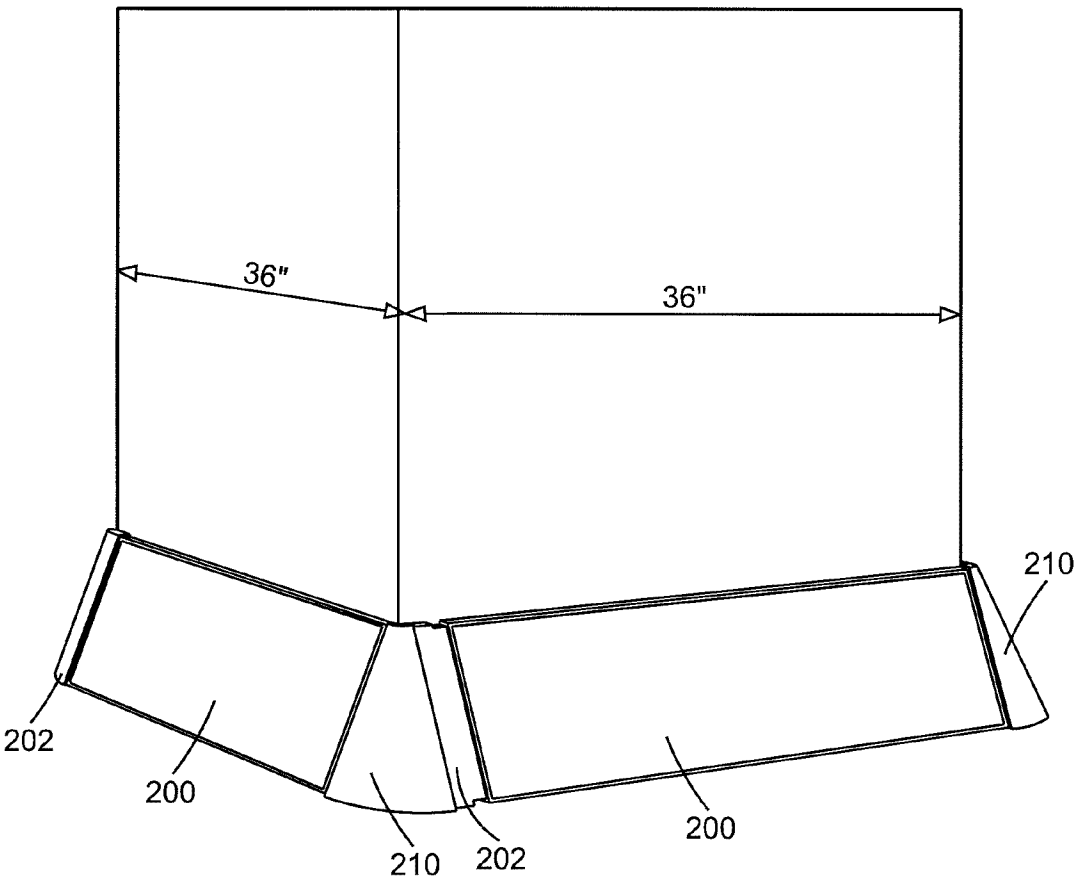
FIG. 38 shows a single pallet protected by a pallet guard according to this embodiment.

FIG. 38 shows this embodiment of the pallet guard arranged around a single pallet.

Figure 39:
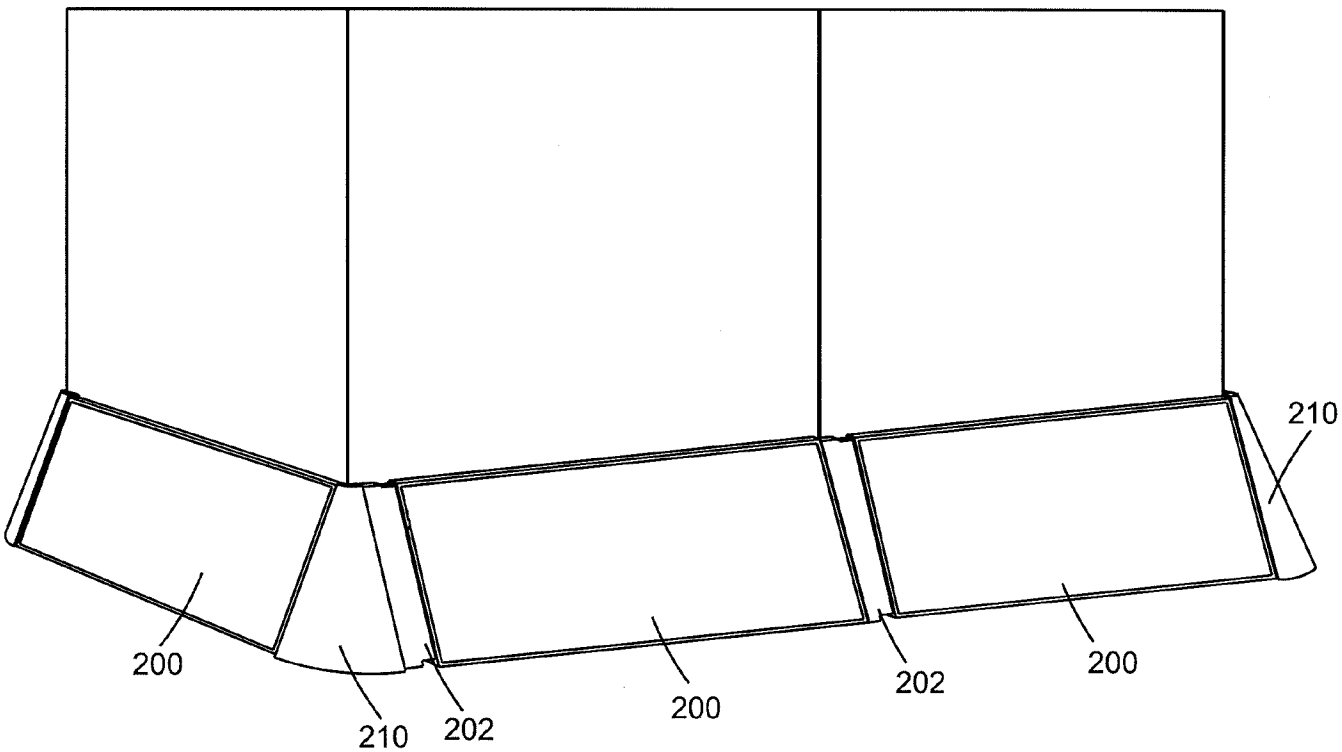
FIG. 39 shows a plurality of pallets protected by the pallet guard of this embodiment.

FIG. 39 shows this embodiment of the pallet guard arranged around a plurality of pallets.

Figure 43:
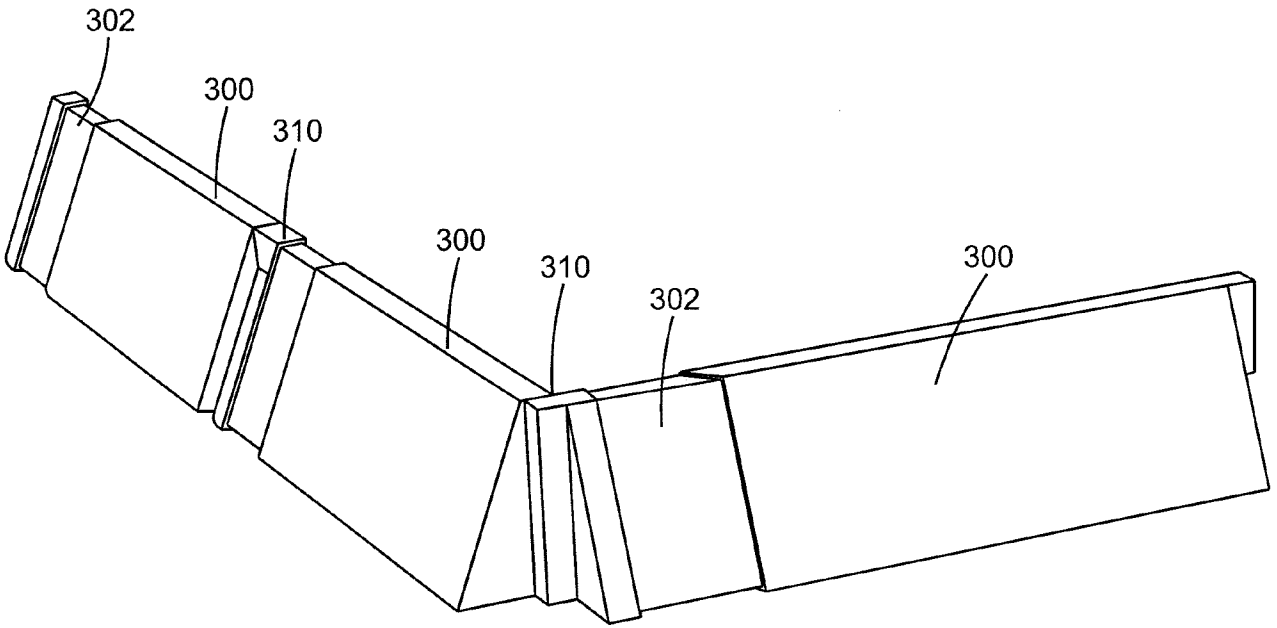
FIG. 43 shows a further embodiment of the pallet guard according to the present invention.

FIG. 43-51 show yet still a further embodiment of the pallet guard according to the present invention. In this embodiment, each modular pallet guard section includes a first section 300 and a section 302 which telescopes into section 300. A joint section 310 is provided connecting each modular section to the adjacent modular section. This joint section 310 comprises end portions of complementary sections 302 and 300 and which can be arranged either 90° or in a straight line configuration as shown in FIG. 43.

Figure 44:
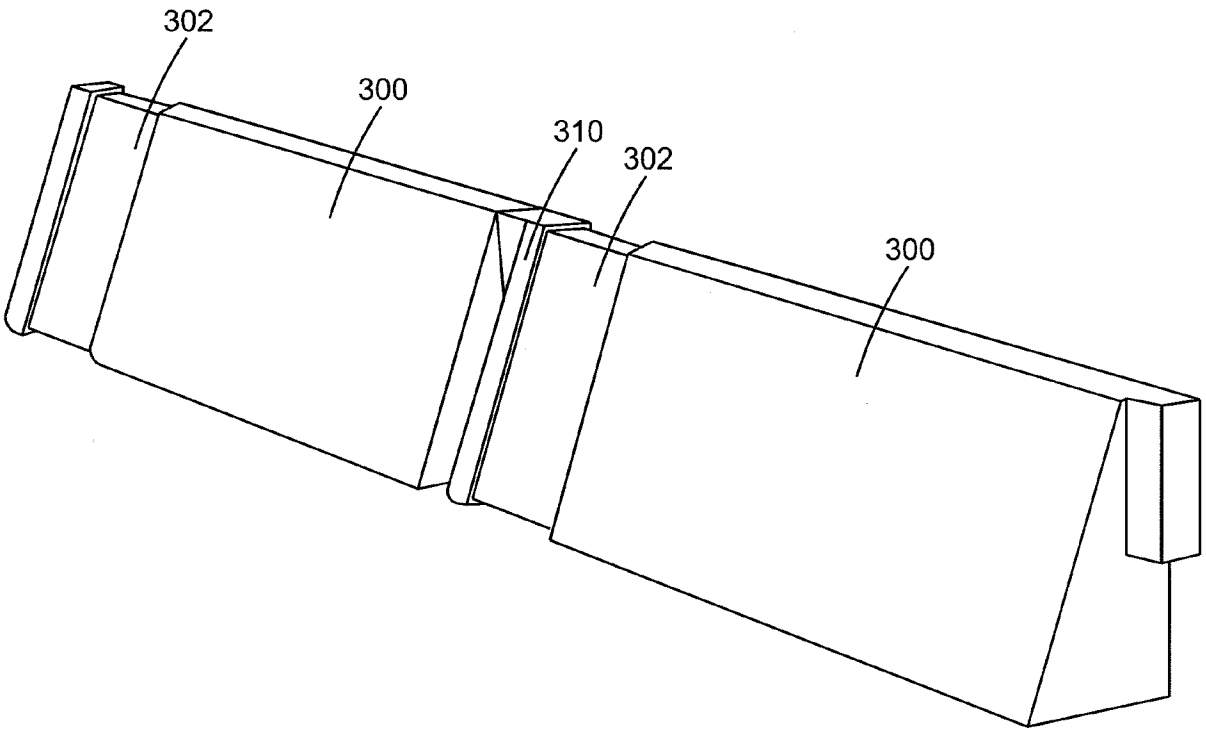
FIG. 44 shows the pallet guard of FIG. 43 in a straight line connection.

FIG. 44 shows two modular sections each comprising sections 300 and 302 arranged in a straight line configuration.

Figure 45:
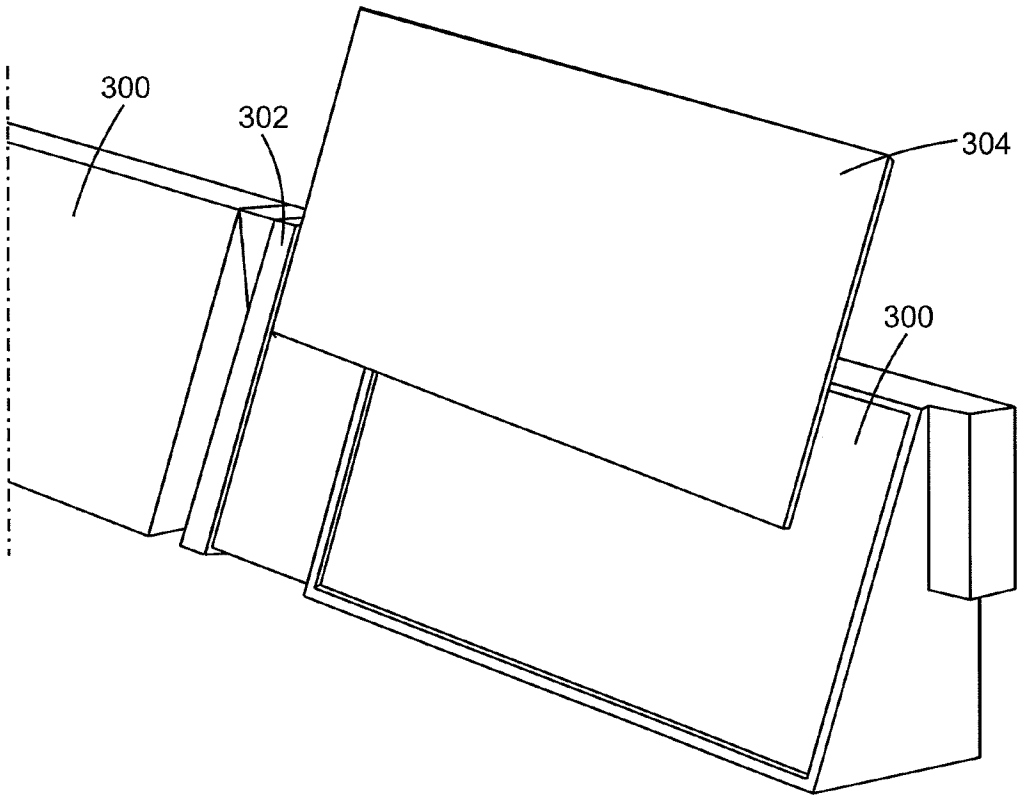
FIG. 45 shows the signage removed from the embodiment of FIG. 44.

FIG. 45 shows the signage 304 removed from one of the pallet guard modular sections. The signage 304 may be maintained in the pallet guard section in the same way as described in any of the other embodiments.

Figure 46:
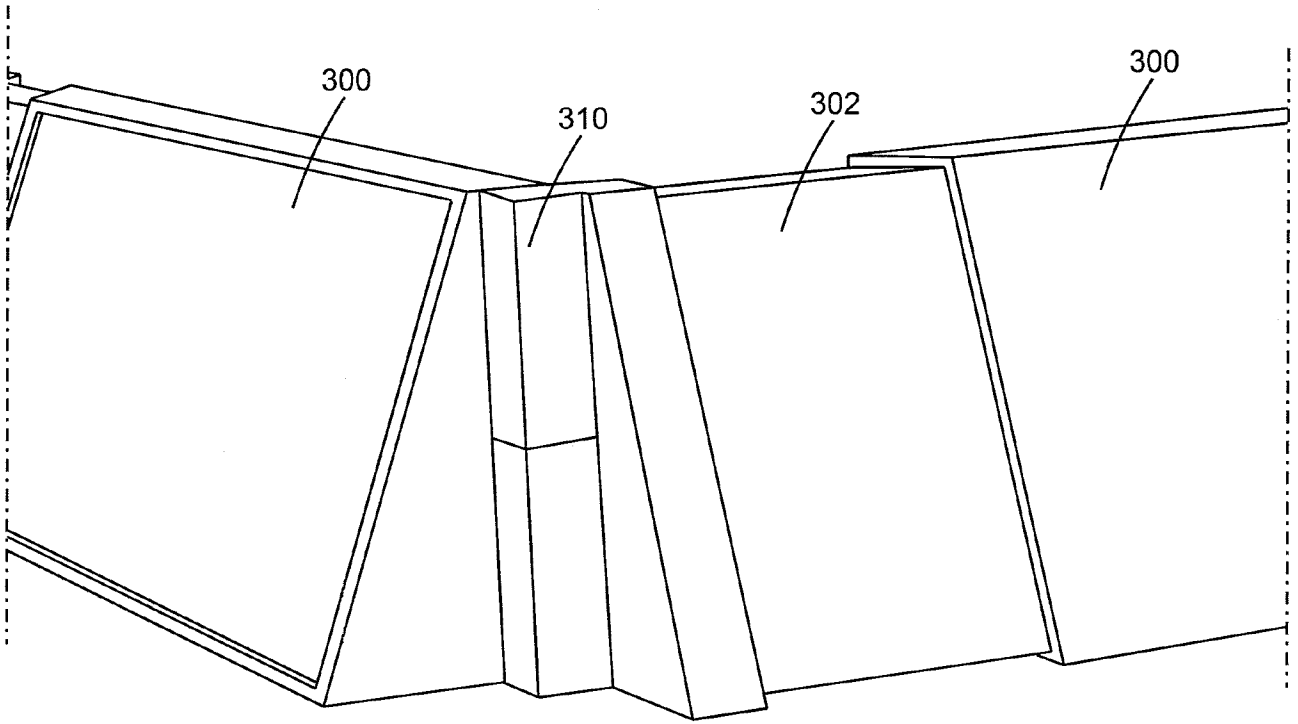
FIG. 46 shows details of the joint between the pallet guard sections in a 90° configuration.
Figure 47:
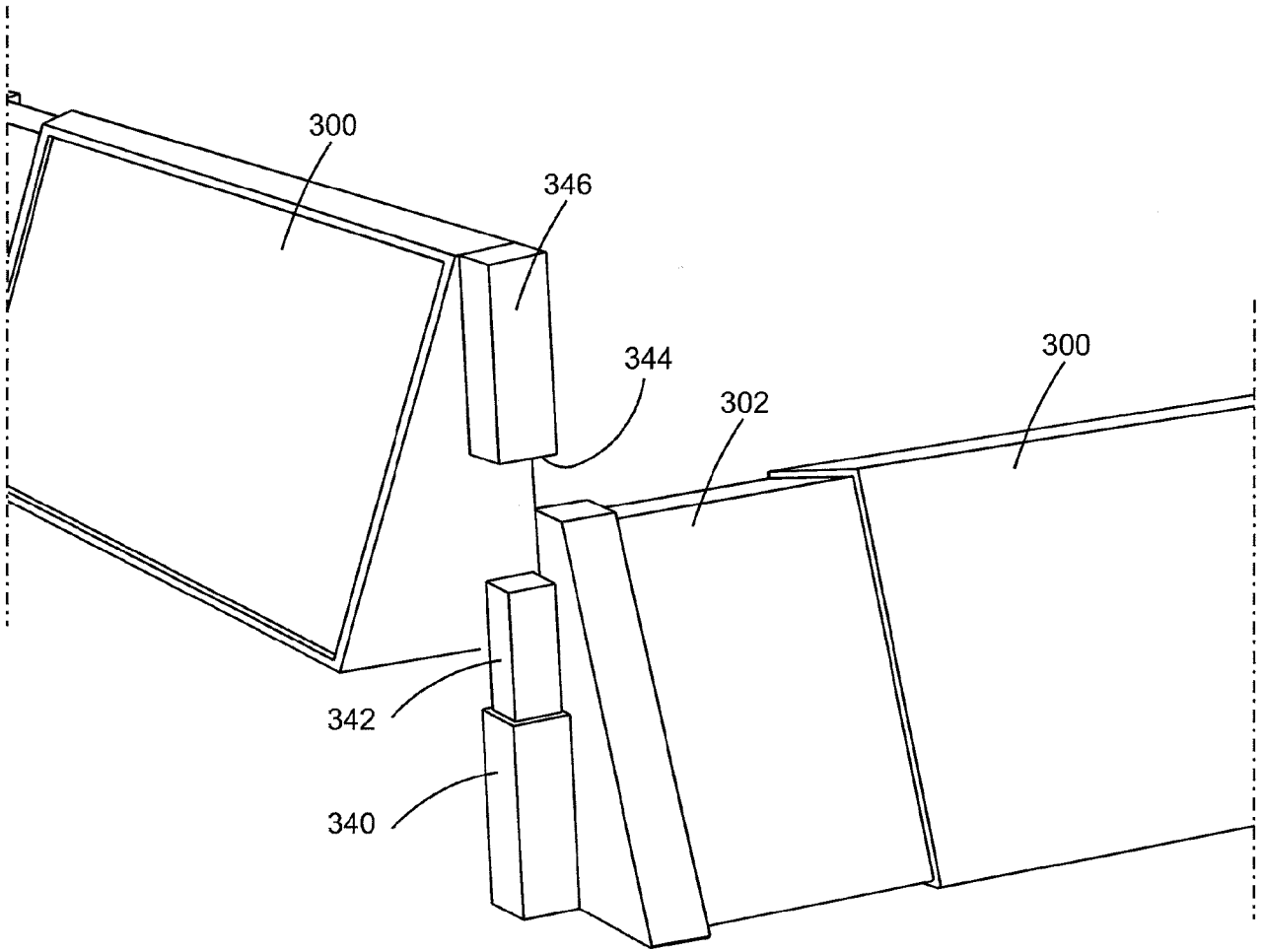
FIG. 47 shows the joint in an exploded view.
Figure 48:
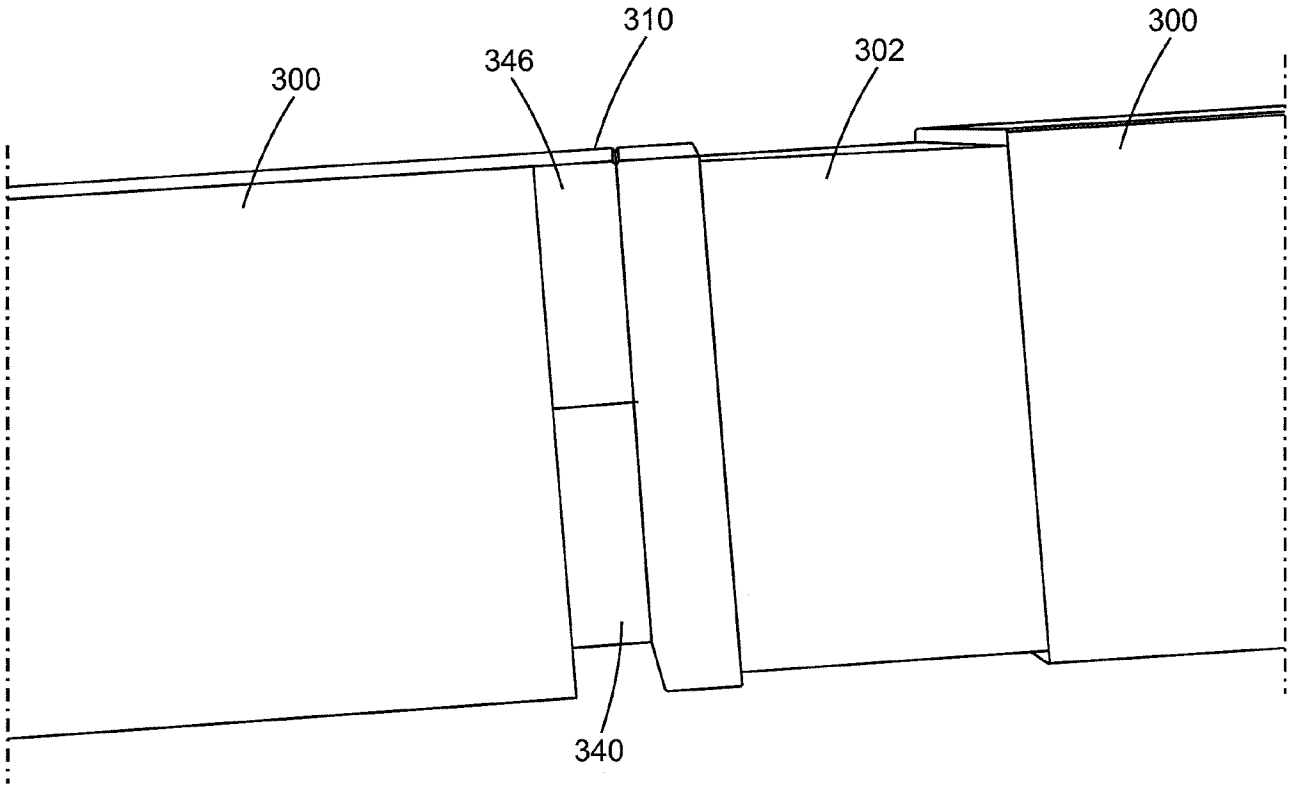
FIG. 48 shows the joint in a straight line connection.
Figure 49:
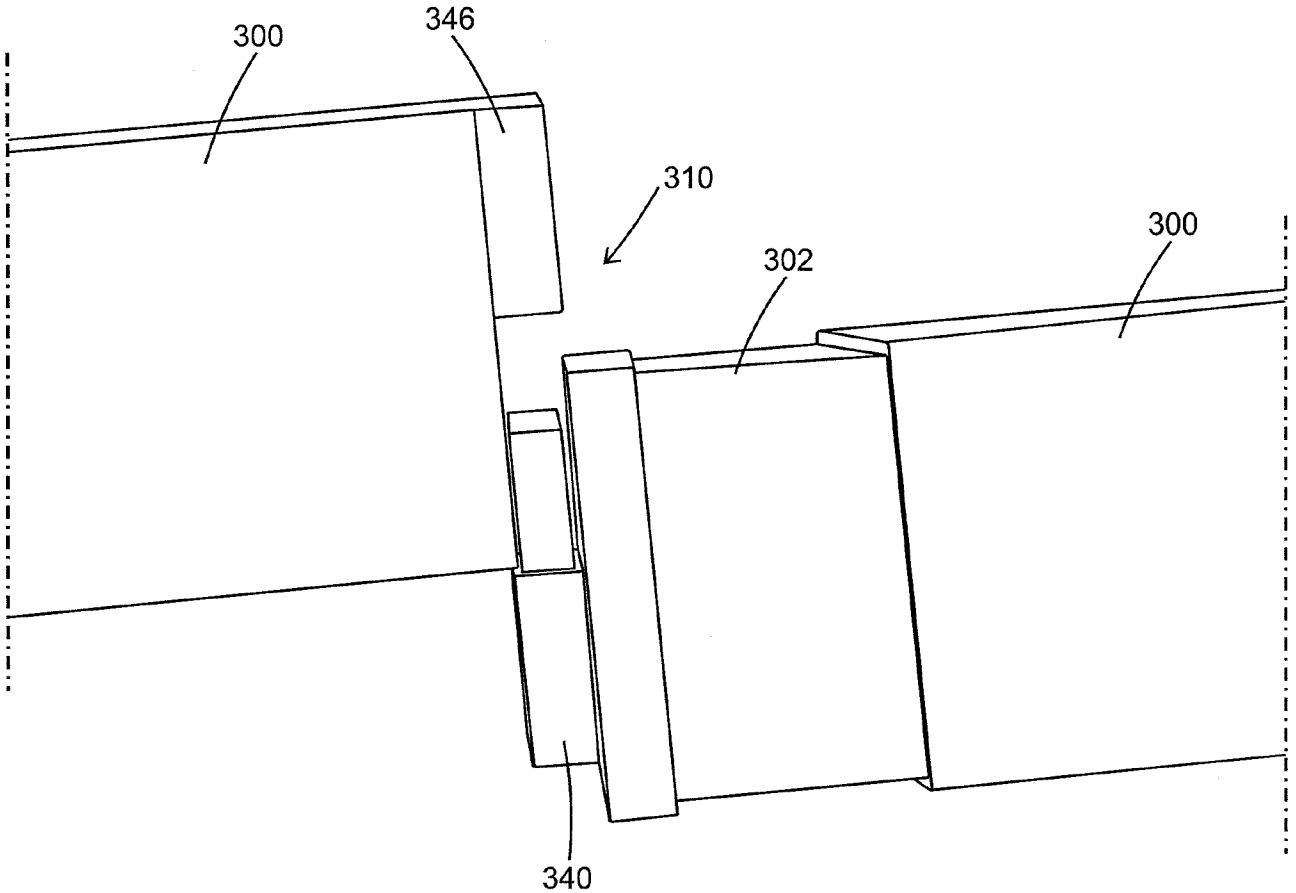
FIG. 49 shows the joint of a straight line connection in an exploded view.

FIG. 46 shows the section 302 coupled to an adjacent section 300 via the joint 310. As shown in FIG. 47, section 302 includes a projecting member 340 having a vertically oriented projection 342 which is received in a recess 344 of a projecting section 346 that projects from a section 300. The members 340 and 346 can be coupled together in the 90° corner arrangement shown in FIGS. 46 and 47 or in the straight line configurations shown in FIGS. 48 and FIG. 49. FIG. 49 shows an exploded view of the joint arranged in a straight line configuration.

Figure 50:
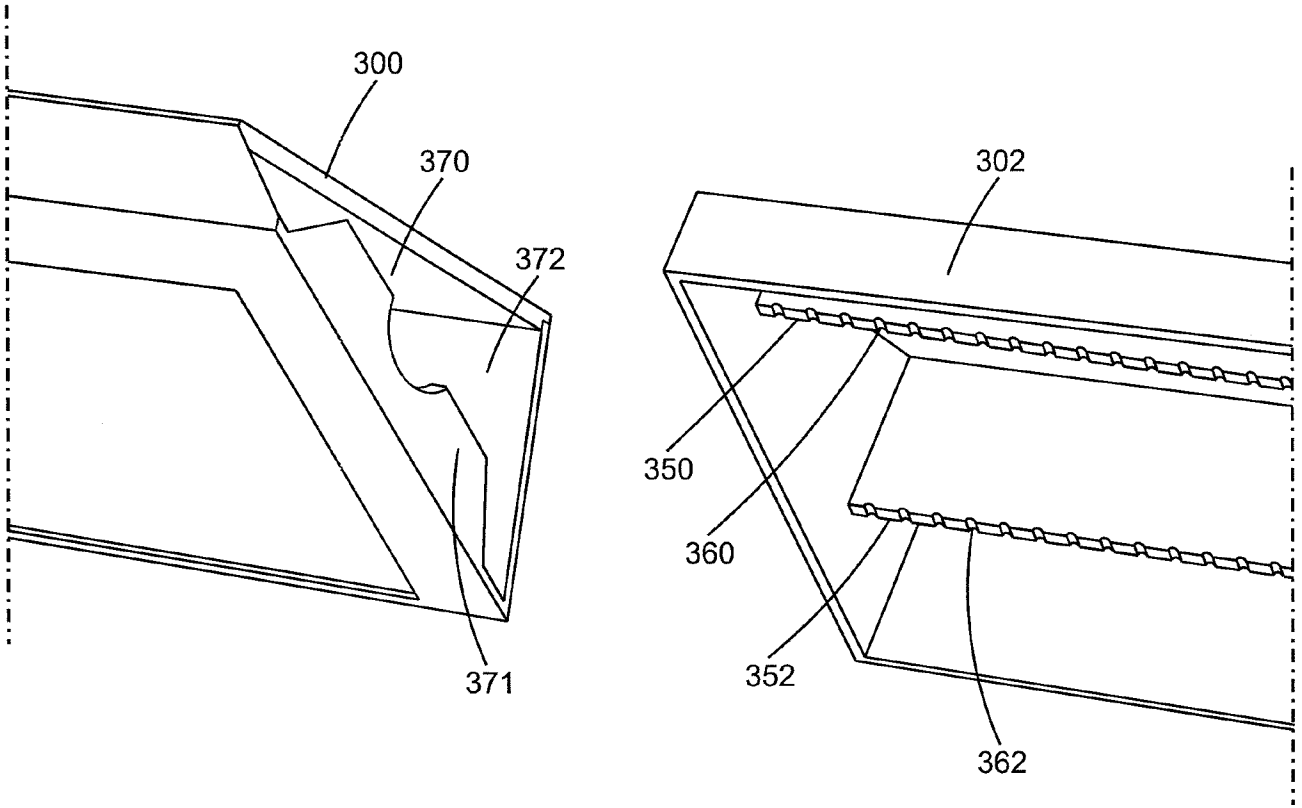
FIG. 50 shows one example of a detent mechanism of this embodiment.

FIG. 50 shows another embodiment of a detent mechanism which can be used with any of the various embodiments described and which may be utilized with the embodiment described with respect to FIGS. 43-51. As shown, the detent mechanism includes two horizontally extending members 350 and 352 each provided with a plurality of notches 360, 362, respectively. When telescoping member 302 is received in member 300, notches 362 receive, depending upon the adjustment of the members 300 and 302, an edge 372 of a vertically aligned fin 371 and notches 360 receive a vertically aligned edge 370 of the fin 371.

Figure 51:
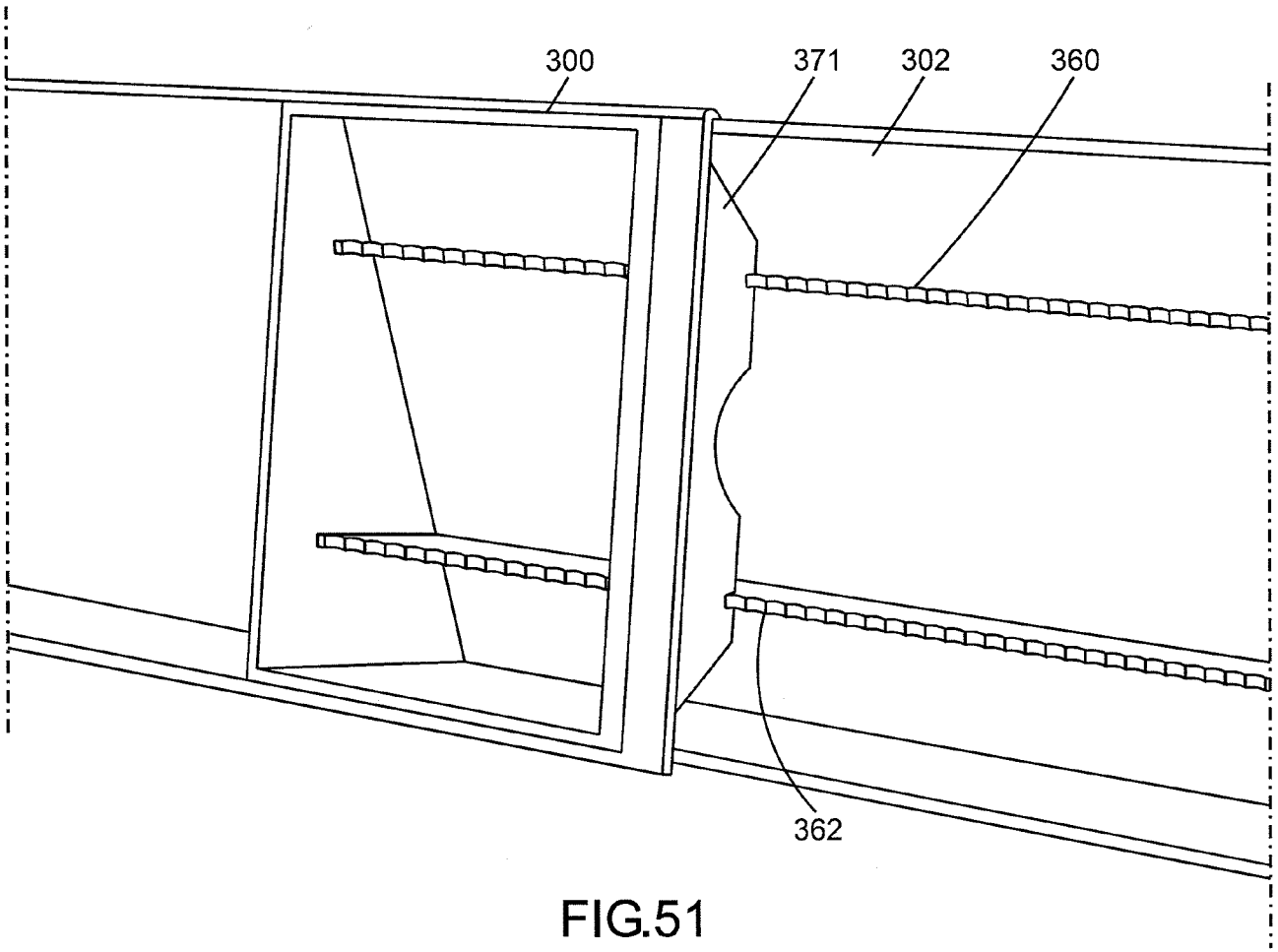
FIG. 51 shows further details of the detent mechanism.

FIG. 51 shows the detent mechanism when the members 300 and 302 are telescoped together showing how the fin 371 is received in respective pairs of the matches 360, 362 to effect a detent adjustment of the two members 300 and 302 whereby the members 300 and 302 can be adjusted in a detented fashion to the desired length.

FIG. 52 shows how the pallet guard section can be used to protect a merchandise rack and wherein the pallet guard section or sections are attachable to the rack stanchion or stanchions with an attachment member. The pallet guard sections can be wedge-shaped or non-wedge-shaped, i.e., rectangular in cross section.

Figure 52A:
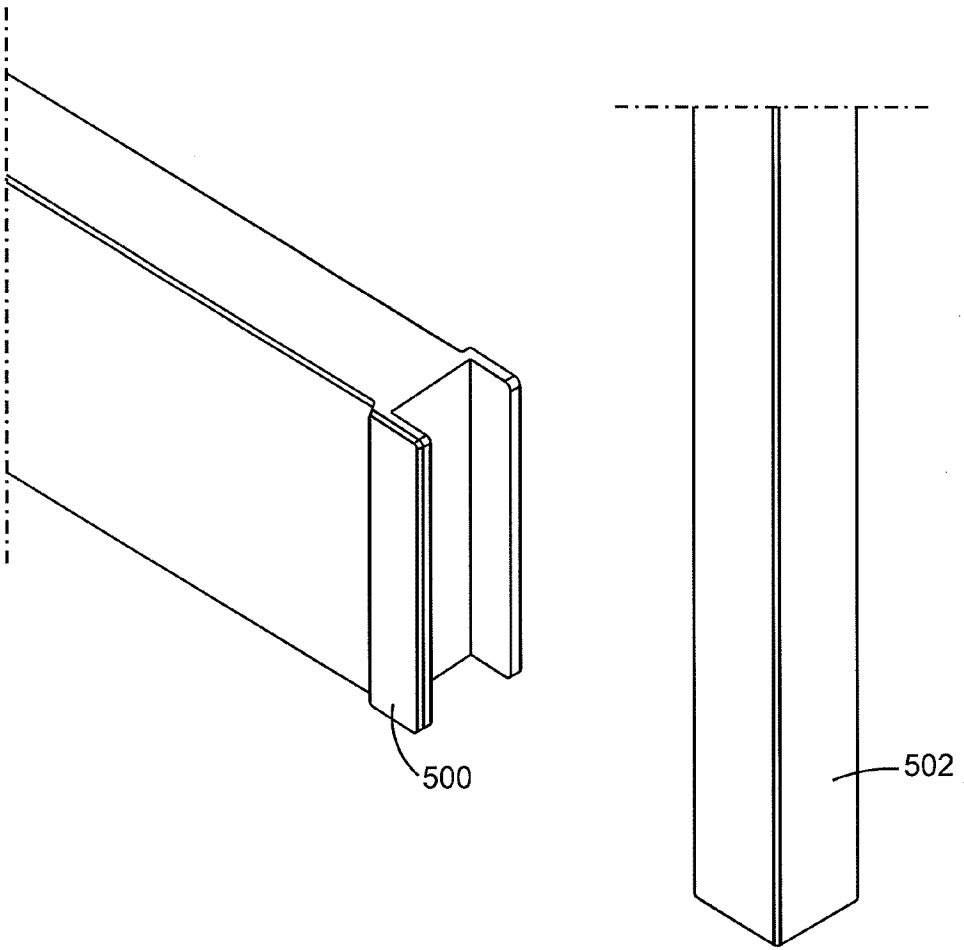
FIGS. 52A to 52I, shows three embodiments of a guard section attached to a stanchion of a merchandise rack.
Figure 52B:
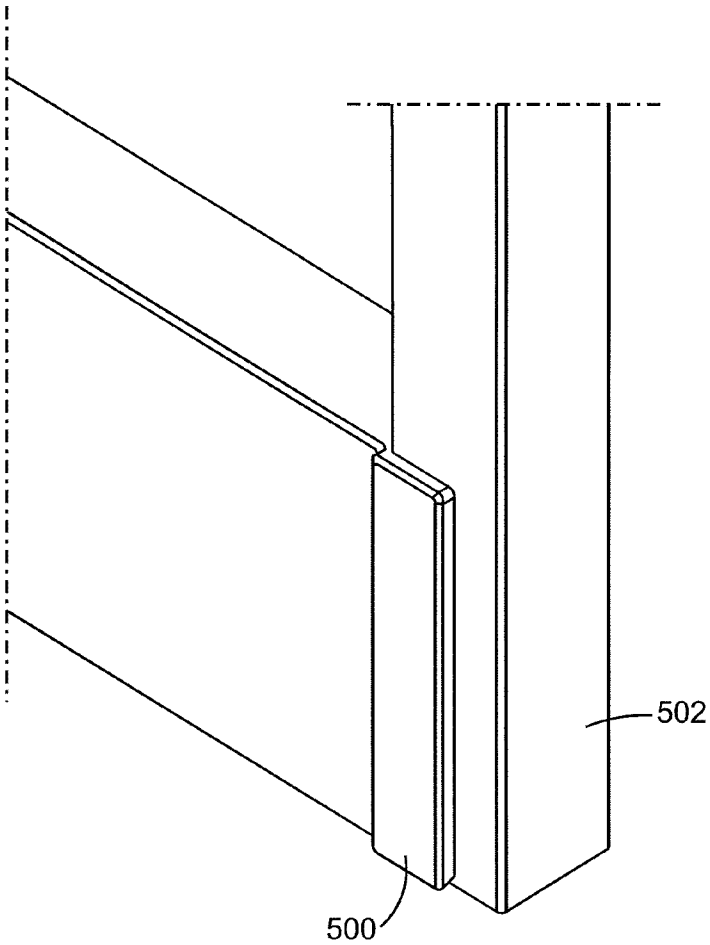
Figure 52C:
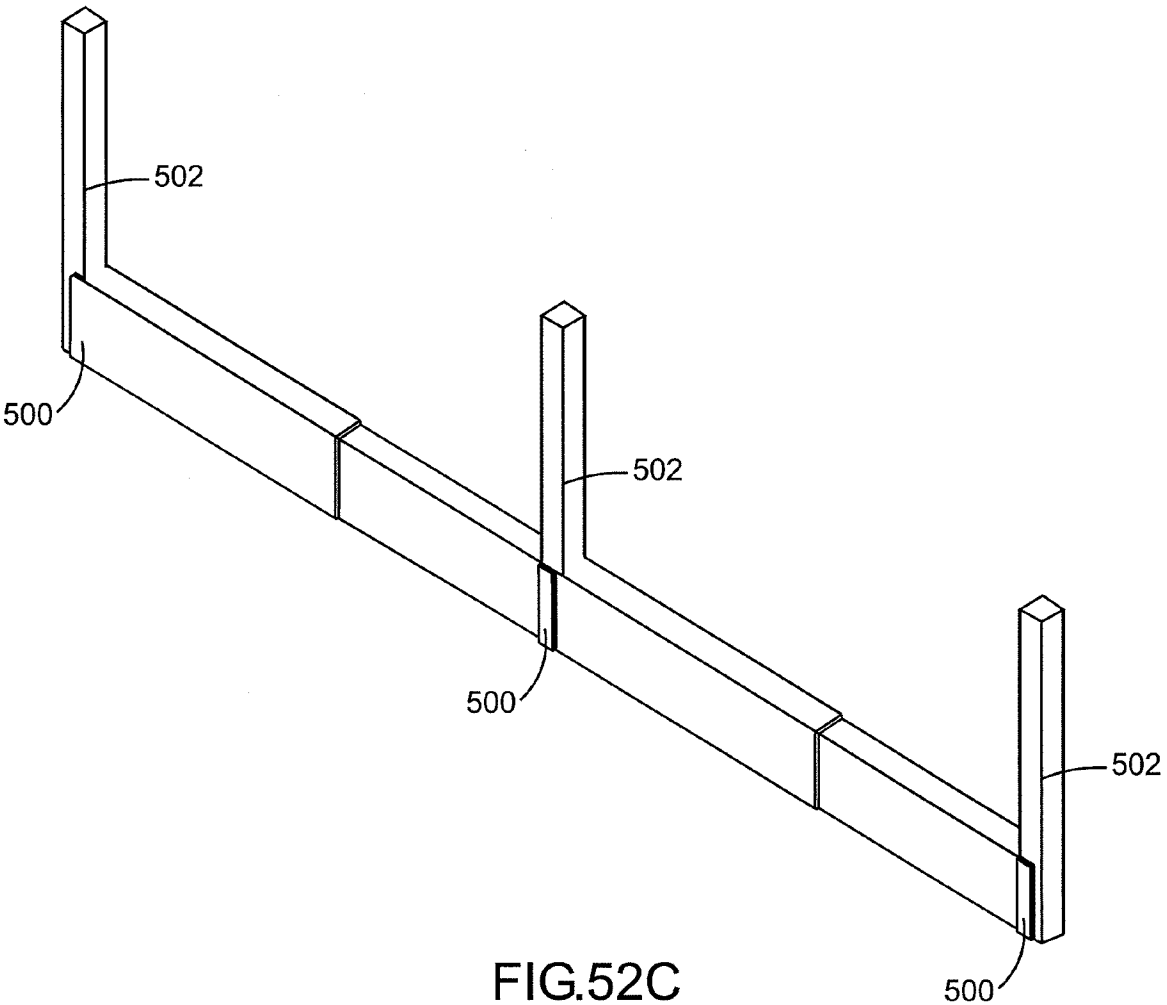

FIGS. 52A to C show a first embodiment comprising a slide-on or snap on embodiment wherein the channel 500 of the guard section slides or snaps onto the stanchion 502. FIGS. 52C shows two adjustable guard sections fastened to three stanchions 502.

Figure 52D:
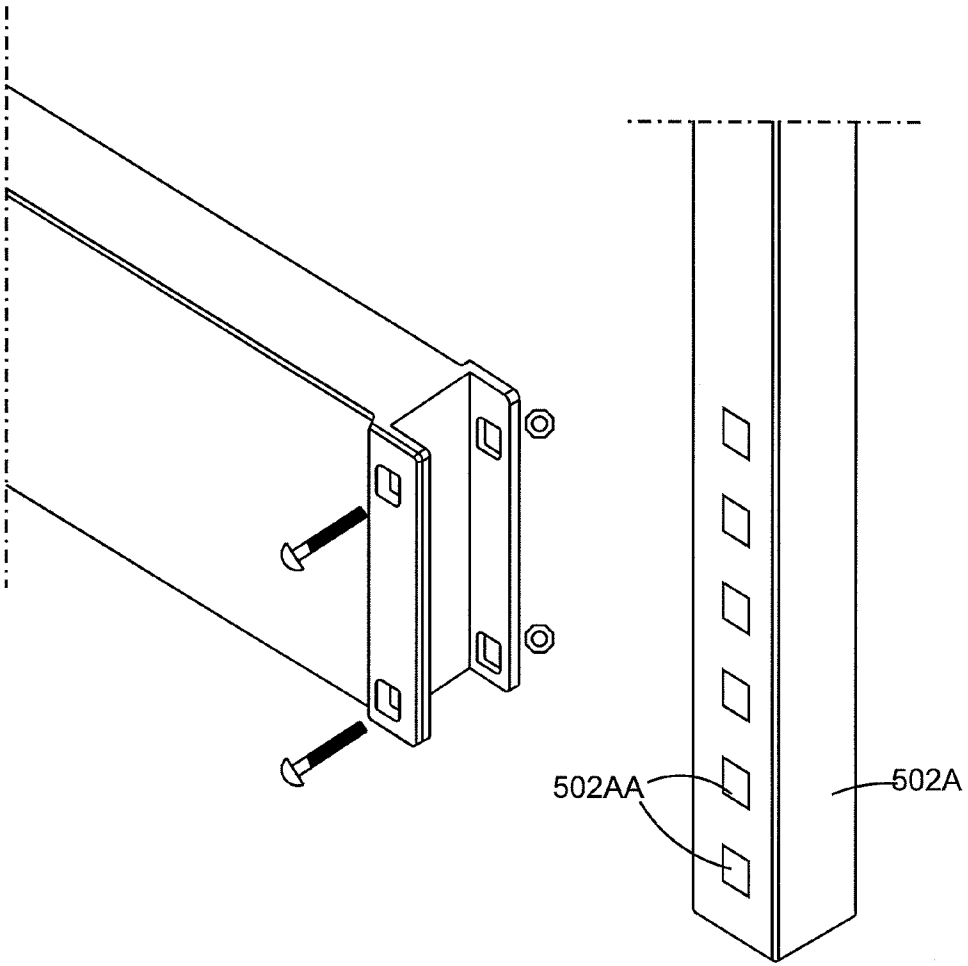
Figure 52E:
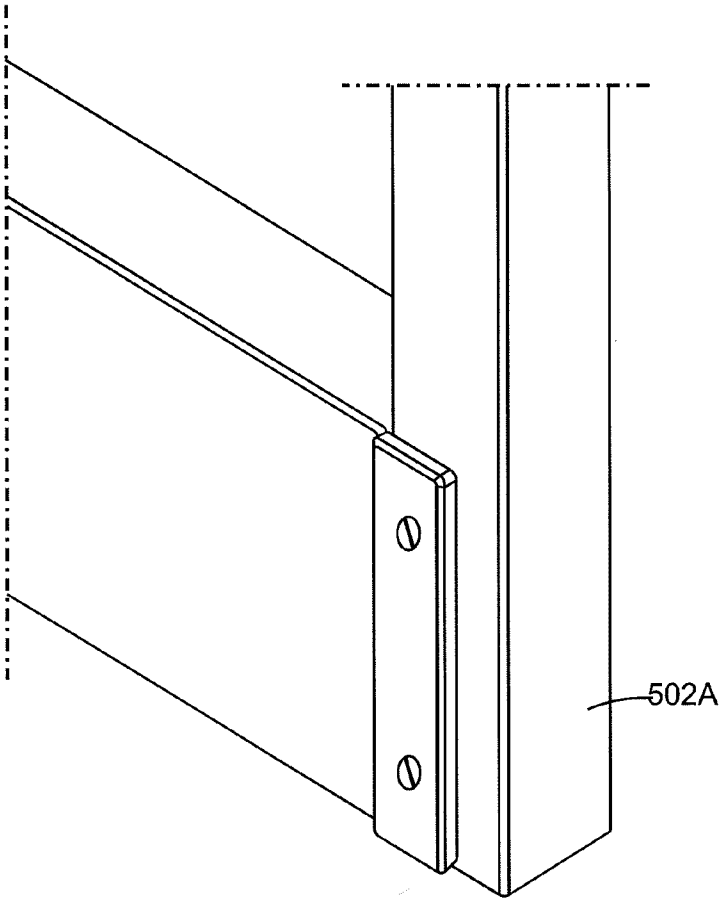
Figure 52F:
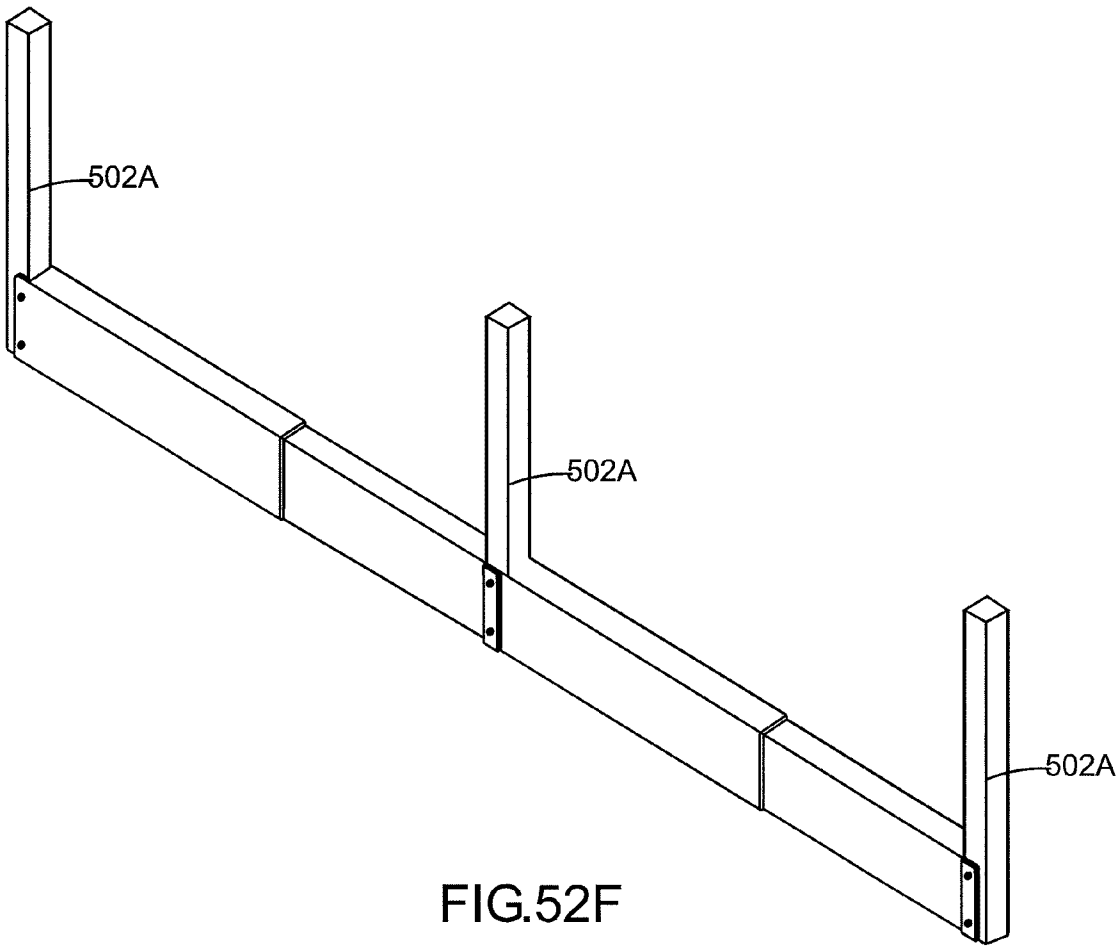

FIG. 52D to F show a second bolt-on embodiment. The stanchion 502A has holes 502AA to receive the bolts.

Figure 52G:
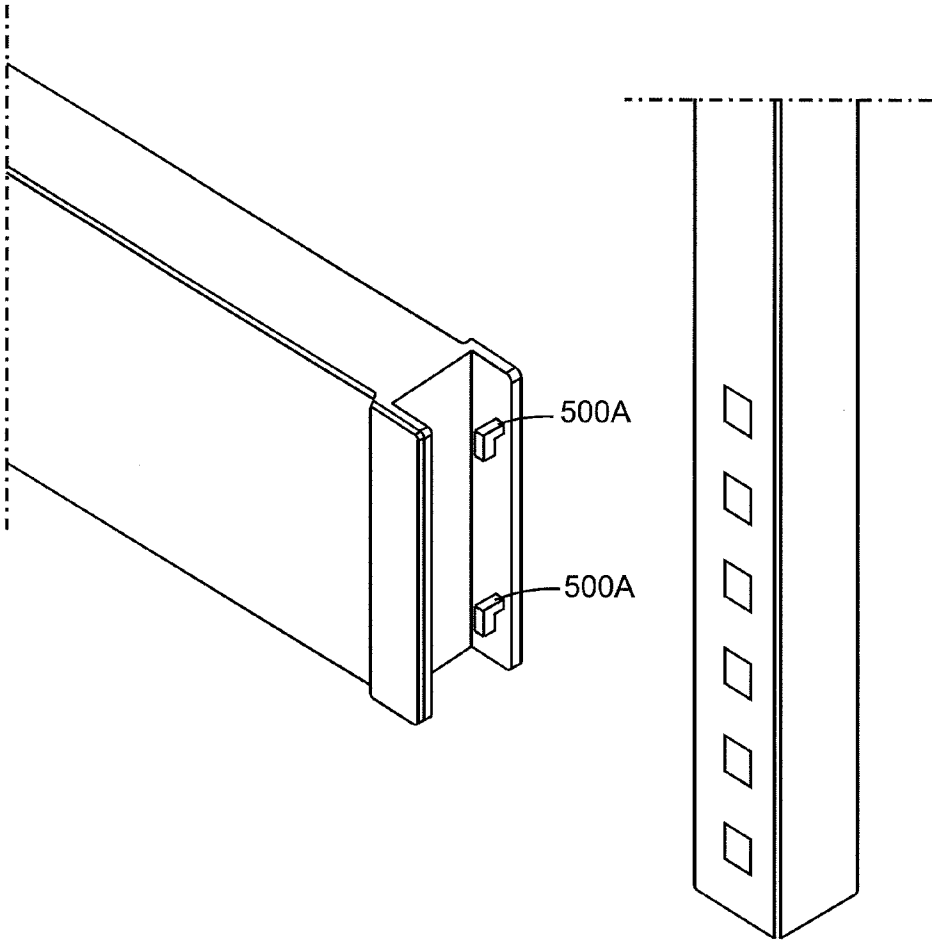
Figure 52H:
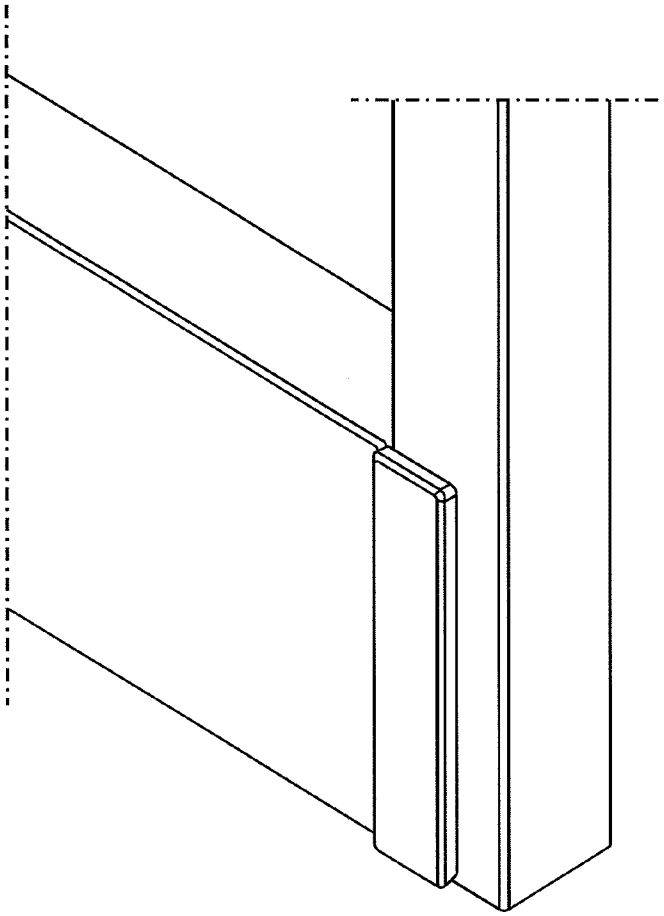
Figure 52I:
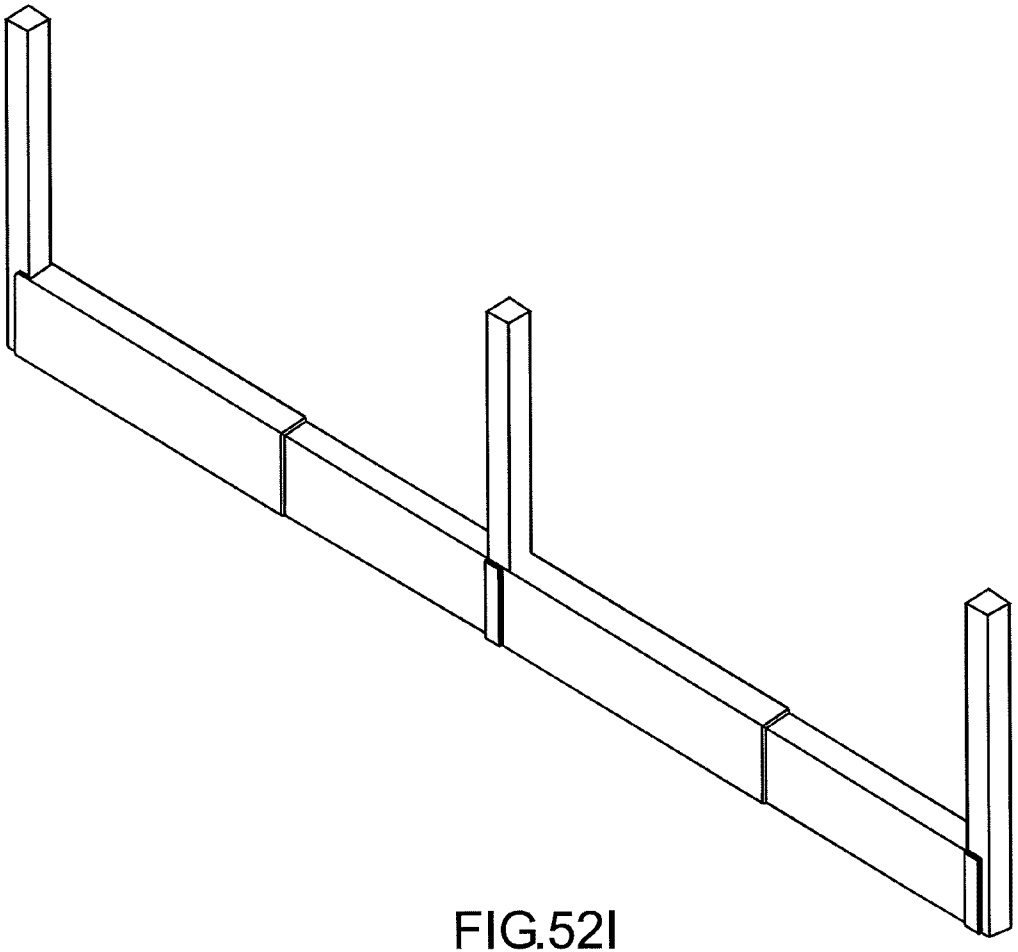

FIGS. 52G to I show a third clip-on embodiment wherein the channels have hook-shaped tabs 500A that engage and hook over the holes in the stanchion to maintain the guard sections in position.

As understood herein, the term "pallet guard" is used to denote a protective guard for a pallet on which goods are stacked as well as a protector for a grouping of merchandise stacked directly on a floor or support surface without a pallet.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A guard for protecting the sides of a pallet on which goods can be stacked or a merchandise grouping placed on a support surface, the guard comprising:

a plurality of modular guard sections, each section being couplable to an adjacent section to surround at least a portion of the perimeter of a pallet or merchandise grouping, each modular guard section having top and bottom portions disposed between front and back portions, the bottom portion being wider than the top portion making each modular guard section substantially wedge or triangular shaped in cross section to increase the stability of the guard section, the guard sections each having a complementary portion of a joint for coupling the sections together, wherein the modular guard sections each comprise at least two telescoping members to allow adjustability of the length of a guard section;

further wherein each guard section comprises complementary detent elements that allow the telescoping members to attain respective detented positions.

2. The guard of claim 1, wherein the joint comprises a joint member coupled to adjacent guard sections, the joint comprising a live hinge.

3. The guard of claim 1, wherein the joint comprises a fixed corner section providing a 90° corner, the fixed corner section being removable to allow adjacent guard sections to connect with each other in an in-line configuration.

4. The guard of claim 1, wherein the complementary joint portions comprise a pivotal connection.

5. The guard of claim 4, wherein the pivotal connection comprises a member that rotates inside an adjacent guard section to any angle between 0° and 90°, forming an exposed rounded corner.

6. The guard of claim 4, wherein the complementary joint portions allow the guard sections to be arranged at any angle between and including 90° and a straight line.

7. The guard of claim 1, wherein the joint comprises a recessed portion on one guard section and a hollow end on another guard section with a corner section fitting slidably over the recessed portion and having a recessed portion that slides into the hollow end.

8. The guard of claim 1, wherein the joint comprises an upright triangular channel on one guard section and a projecting upright triangular channel on the other guard section.

9. The guard of claim 8, further comprising a corner section having a projecting channel to be slidably received in the triangular channel of the one guard section and a triangular channel to be received in the projecting channel of the other guard section.

10. The guard of claim 1, wherein one of the telescoping members has a stop lip that engages with a bridge in an open bottom of the guard section to serve as a stop member to limit the maximum extent of adjustment.

11. The guard of claim 1, wherein at least one of the guard sections has an outwardly facing surface having an area for the receipt of a removable signage member.

12. The guard of claim 1, wherein the complementary portions of the joint allow the guard sections to be coupled together to form a corner or be disposed in a straight line.

13. The guard of claim 1, wherein the complementary detent elements comprise at least one projection on one telescoping member and a plurality of recesses on the other telescoping member.

14. The guard of claim 13, wherein the at least one projection is provided on the top of one telescoping member and the recesses on the top of the other telescoping member.

15. The guard of claim 1, wherein the complementary detent elements comprise a fin element on one telescoping member and a plurality of notches for receiving the fin element on the other telescoping member.

16. A guard for protecting a face side or multiple face sides of a pallet on which goods can be stacked or a merchandise grouping placed on a support surface, the guard comprising:

at least one guard section to cover the face side or sides of a pallet or merchandise grouping, each guard section having top and bottom portions disposed between front and back portions, the bottom portion being wider than the top portion making each modular guard section substantially wedge or triangular shaped in cross section to increase the stability of the guard section; and wherein the guard sections each comprise at least two telescoping members to allow adjustability of the length of a guard section;

further wherein the guard section comprises an attachment member to attach the guard section to a vertically extending member of a merchandise rack or stanchion of a merchandise rack.

17. The guard of claim 16, wherein the attachment member comprises a vertical channel having an interior space for receiving the vertically extending member of a merchandise rack or a stanchion of a merchandise rack within the interior space.

18. The guard of claim 17, wherein the vertical channel receives the vertically extending member of a merchandise rack or stanchion slidably or with a snap fit.

19. The guard of claim 17, wherein the vertical channel receives the vertically extending member of a merchandise rack or stanchion using bolts through holes in the channel and rack or stanchion.

20. The guard of claim 17, wherein the vertical channel or rack or stanchion has hook shaped members that engage in holes to secure the channel to the rack or stanchion.

21. A guard for protecting a face side or multiple face sides of a pallet on which goods can be stacked or merchandise groupings placed on a support surface, the guard comprising:

at least one guard section to cover the face side or face sides of a pallet or merchandise grouping and wherein the guard section comprises an attachment member to attach the guard section to a vertically extending member of a merchandise rack or stanchion of a merchandise rack, the guard section comprising two telescoping members to allow adjustability of the length of the guard section.

22. The guard of claim 21, wherein the guard section comprises a vertical channel for receiving the vertically extending member of a merchandise rack or a stanchion of a merchandise rack.

23. The guard of claim 22, wherein the vertical channel receives the vertically extending member of a merchandise rack or stanchion slidably or with a snap fit.

24. The guard of claim 22, wherein the vertical channel receives the vertically extending member of a merchandise rack or stanchion using bolts through holes in the channel and rack or stanchion.

25. The guard of claim 22, wherein the vertical channel or rack or stanchion has hook shaped members that engage in holes to secure the channel to the rack or stanchion.

* * * * *